US011280539B2

(12) United States Patent
Kim et al.

(10) Patent No.: US 11,280,539 B2
(45) Date of Patent: Mar. 22, 2022

(54) REFRIGERATOR

(71) Applicant: LG ELECTRONICS INC., Seoul (KR)

(72) Inventors: Minsub Kim, Seoul (KR); Kyukwan Choi, Seoul (KR); Sanghun Kim, Seoul (KR); Yong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 3 days.

(21) Appl. No.: 17/007,554

(22) Filed: Aug. 31, 2020

(65) Prior Publication Data

US 2021/0080167 A1 Mar. 18, 2021

(30) Foreign Application Priority Data

Sep. 17, 2019 (KR) ..... 10-2019-0114286

(51) Int. Cl.
*F25D 23/02* (2006.01)
*F25D 25/02* (2006.01)
*F25D 23/06* (2006.01)

(52) U.S. Cl.
CPC ..... *F25D 23/025* (2013.01); *F25D 25/02* (2013.01); *F25D 25/027* (2013.01); *F25D 23/065* (2013.01); *F25D 2323/023* (2013.01); *F25D 2325/021* (2013.01)

(58) Field of Classification Search
CPC .. F25D 23/025; F25D 25/02; F25D 2325/021; F25D 23/04; F25D 25/027; F25D 23/067; F25D 25/04; F25D 23/065; F25D 2323/023; F25D 25/024; E05Y 2900/31; A47B 57/06; A47B 57/32; A47B 57/08; A47B 57/10
See application file for complete search history.

(56) References Cited

U.S. PATENT DOCUMENTS 3,885,846 A * 5/1975 Chuang ..... A47B 57/482 312/306
5,913,584 A * 6/1999 Swindell ..... F25D 25/02 312/408
6,085,542 A * 7/2000 Johnson ..... F25D 23/04 312/292
8,226,184 B2 * 7/2012 Kang ..... F25D 25/02 312/408
8,419,143 B2 * 4/2013 Shin ..... F25D 25/02 312/408
8,529,001 B2 * 9/2013 Calvillo ..... F25D 25/02 312/408
9,518,776 B2 * 12/2016 Baldo ..... F25D 23/028
9,879,901 B2 * 1/2018 Lim ..... F25D 23/025
2010/0060124 A1 3/2010 Kang et al.
2010/0176702 A1 * 7/2010 Kim ..... F25D 23/04 312/405.1

(Continued)

FOREIGN PATENT DOCUMENTS

KR 10-2008-0045368 A 5/2008
KR 2020090001784 U 2/2009

(Continued)

*Primary Examiner* — Hiwot E Tefera
(74) *Attorney, Agent, or Firm* — Dentons US LLP

(57) ABSTRACT

A refrigerator may include a shelf provided on a door and a shelf guard provided to be movable in front of the shelf so that a user can easily take out food.

28 Claims, 15 Drawing Sheets

(56) References Cited

U.S. PATENT DOCUMENTS

| | | | | |
|---|---|---|---|---|
| 2010/0326122 | A1* | 12/2010 | Seo | F25D 23/04 62/449 |
| 2013/0081423 | A1* | 4/2013 | Kwon | F25D 23/028 62/449 |
| 2013/0119849 | A1* | 5/2013 | Gwak | F25D 23/04 312/405.1 |
| 2014/0062283 | A1* | 3/2014 | Baldo | F25D 23/028 312/405.1 |
| 2016/0003520 | A1* | 1/2016 | Wang | F25D 23/04 312/405.1 |
| 2016/0273825 | A1* | 9/2016 | Lim | F25D 23/067 |
| 2017/0321957 | A1* | 11/2017 | Erol | F25D 25/02 |
| 2017/0350637 | A1* | 12/2017 | Kwon | F25D 23/04 |

FOREIGN PATENT DOCUMENTS

| | | | |
|---|---|---|---|
| KR | 1020100036600 | A | 4/2010 |
| KR | 1020160112301 | A | 9/2016 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2019-0114286 (filed on Sep. 17, 2019), which is hereby incorporated by reference in its entirety.

BACKGROUND

In general, refrigerators are home appliances for storing food at a low temperature in a storage space that is covered by a door.

A shelf that is capable of accommodating food may be provided on the door of the refrigerator, and a shelf guard that provides a protrusion having a predetermined height may be provided at a front portion of the shelf to prevent the food from falling.

When a user takes out the food stored on the shelf, there is a limitation in that the food is not easy to take out because the food gets caught on the protrusion.

A plurality of shelves may be provided on the door of the refrigerator, and the plurality of shelves may be arranged to be spaced apart from each other in a vertical direction. A height between two adjacent shelves is limited, and thus, is a limitation in that it is not easy to store food having a high vertical height on the shelves.

The prior art document related to a shelf having an adjustable height in the refrigerator is as follows.

1. Patent Publication No. (Date of Publication): 10-2008-0045368 (May 23, 2008).

2. Title of The Invention: STRUCTURE FOR ADJUSTING HEIGHT OF REFRIGERATOR SHELF

SUMMARY

Embodiments provide a refrigerator in which a shelf guard rotates so that top surfaces of a shelf and the shelf guard are flat with respect to each other, and food is easily taken out along the flat surface.

Embodiments also provide a refrigerator in which, when a refrigerator door is opened, an upper portion of a shelf guard rotates with respect to a lower portion of the shelf guard in a top and down manner to allow the shelf guard to extend to a front side of the door.

Embodiments also provide a refrigerator having a door, in which a plurality of shelves are arranged in a vertical direction, and a plurality of shelf guards are provided, wherein the plurality of shelf guards rotate together so that a user does not need to manipulate the shelf guards one by one so as to extend the shelf guards.

Embodiments also provide a refrigerator in which a shelf guard acts with a refrigerator door to perform rotation of the shelf guard by opening or closing the refrigerator door, thereby improving user's convenience.

Embodiments also provide a refrigerator in which a shelf is adjusted in height to change a height of an accommodation space.

Embodiments also provide a refrigerator in which a shelf is easily adjusted in height by user's lever manipulation.

Embodiments also provide a refrigerator in which a shelf guard is rotatable, and a shelf is adjustable in height.

A refrigerator according to an embodiment may include a shelf provided on a door and a shelf guard provided to be movable in front of the shelf so that a user easily takes out food.

Particularly, the shelf guard may rotate in a top and down manner in which an upper portion of the shelf guard moves downward with respect to a lower portion of the shelf guard so that top surfaces of the shelf and the shelf guard provide a flat surface, and the user easily takes the food out of the shelf.

The refrigerator may be provided with a projection provided on a sub door and a moving part provided on a main door to contact the projection and connected to the shelf guard.

In a process of opening the sub door, when the contact between the projection and the moving part is released, the moving part may guide the rotation of the shelf guard while advancing forward so that the user does not need to perform separate manipulation so as to allow the shelf guard to rotate.

The refrigerator may include the plurality of shelves arranged to be spaced apart from each other in a vertical direction, and the plurality of shelf guards may rotate together to improve user's convenience.

The refrigerator may include the shelf that is adjustable in height in the vertical direction to change a height of a storage space.

The user may manipulate a lever to separate the shelf supported on the door and release connection between a gear and a rack gear, thereby adjusting the vertical height of the shelf.

Particularly, since a mechanism for the rotation of the shelf guard and a mechanism configured to adjust the height of the shelf may be provided together to realize the movement of the shelf and the shelf guard at the same time, user's convenience may be improved.

In one embodiment, a refrigerator includes: a cabinet configured to define a storage space; a door provided in front of the cabinet, the door including a main door configured to define an opening and a sub door configured to open or close the opening; a shelf provided inside the cabinet; a shelf guard disposed in the opening to protrude upward from a front end of the shelf so as to provide a protrusion, the shelf guard being provided to be movable; and a rotation guide device provided in the door, the guide device being configured to guide the movement of the shelf guard so that, when the sub door is opened or closed, the rotation guide device operates with the sub door to allow the shelf guard to extend to a front side of the opening.

The rotation guide device may include: a projection provided on the sub door; and a moving part provided on the main door, the moving part being configured to be moved by the projection when the sub door closes the opening.

The rotation guide device may further include: a support bracket configured to movably support the moving part; and a bracket guide provided in a space between a front portion and a rear portion of the support bracket, the bracket guide being inserted into the moving part, wherein the moving part may move in a front and rear direction in the space between the front portion and the rear portion of the support bracket.

The rotation guide device may further include a bracket spring provided on the support bracket to provide restoring force to the moving part so that the moving part advances forward when the sub door is opened.

The rotation guide device may further include a gear assembly interlocked with the moving part and coupled to the shelf guard, wherein the gear assembly may include a connection bar coupled to a lateral surface of the shelf guard so that an upper portion of the shelf guard rotates forward with respect to a lower portion of the shelf guard.

Each of the shelf and the shelf guard may be provided in plurality, the rotation guide device may include a rack gear interlocked with the gear assembly so that the plurality of shelf guards rotate together, and the rack gear may extend vertically from lower portion to upper portion of the plurality of shelves.

The gear assembly may be provided in plurality, and each of the plurality of gear assembles may be provided on a side of each of the plurality of shelf guards.

The rotation guide device may further include a reduction gear provided between the plurality of gear assembles and interlocked with the rack gear to reduce a vertical moving speed of the rack gear.

The refrigerator may further include: a support bracket provided on an inner surface of the main door to support the shelf, the support bracket having a plurality of support grooves defined in a vertical direction; and a support plate having a support projection inserted into one of the plurality of support grooves.

The refrigerator may further include: a lever provided on the shelf, the lever being manipulatable to adjust a vertical height of the shelf; and a lever guide disposed in contact with the lever, the lever guide being configured to move in a left and right direction by movement of the lever.

The lever guide may be coupled to the support plate.

The refrigerator may further include a first inclined portion provided on the lever and a second inclined portion provided on the lever guide to contact the first inclined portion, wherein each of the first and second inclined portions may have a surface extending to be inclined in the front and rear direction.

The support plate may be provided between the lateral surface of the shelf and the inner surface of the main door, and when the lever guide moves by the manipulation of the lever, the support plate may move in a direction that approaches the lateral surface of the shelf so that the support projection is separated from the support groove.

The support plate may be coupled to the gear assembly.

The refrigerator may further include a rack gear interlocked with the gear assembly, wherein, when the support plate moves in the direction that approaches the lateral surface of the shelf by the manipulation of the lever, the gear assembly may be separated from the rack gear.

The shelf may include a first shelf, a second shelf spaced upward from the first shelf, and a third shelf spaced upward from the second shelf, and the first and third shelves may be fixed, and the second shelf may be movable in the vertical direction.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
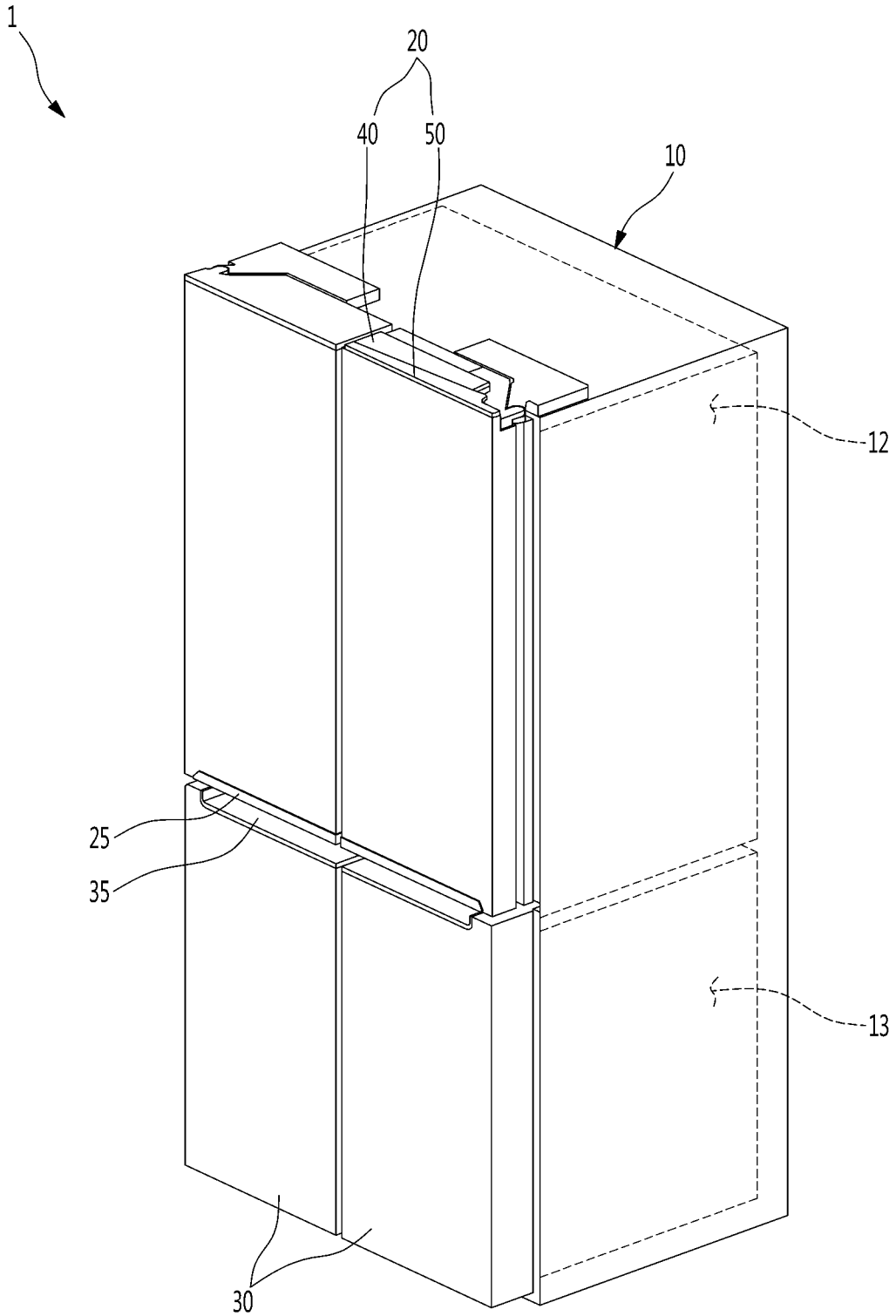
FIG. 1 is a perspective view illustrating constituents of a refrigerator according to an embodiment.
Figure 2:
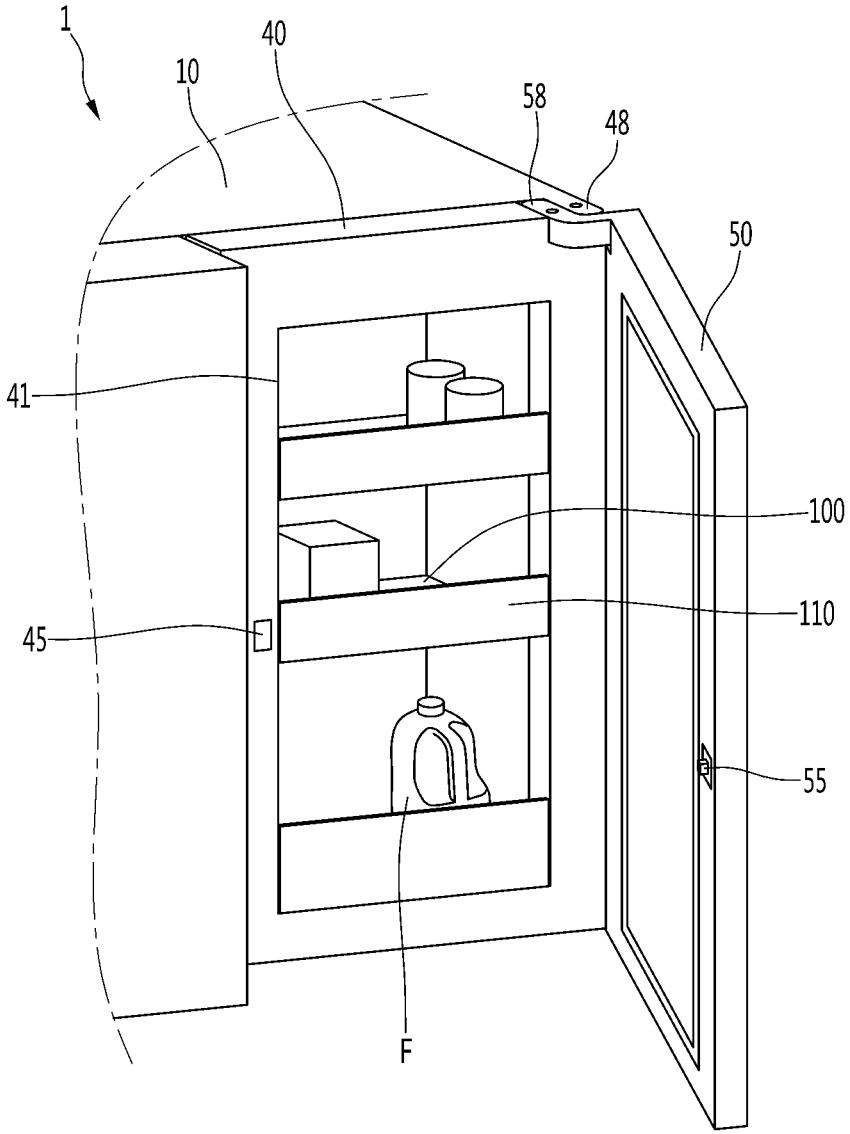
FIG. 2 is a perspective view illustrating constituents of a main door and a sub door according to an embodiment.
Figure 3:
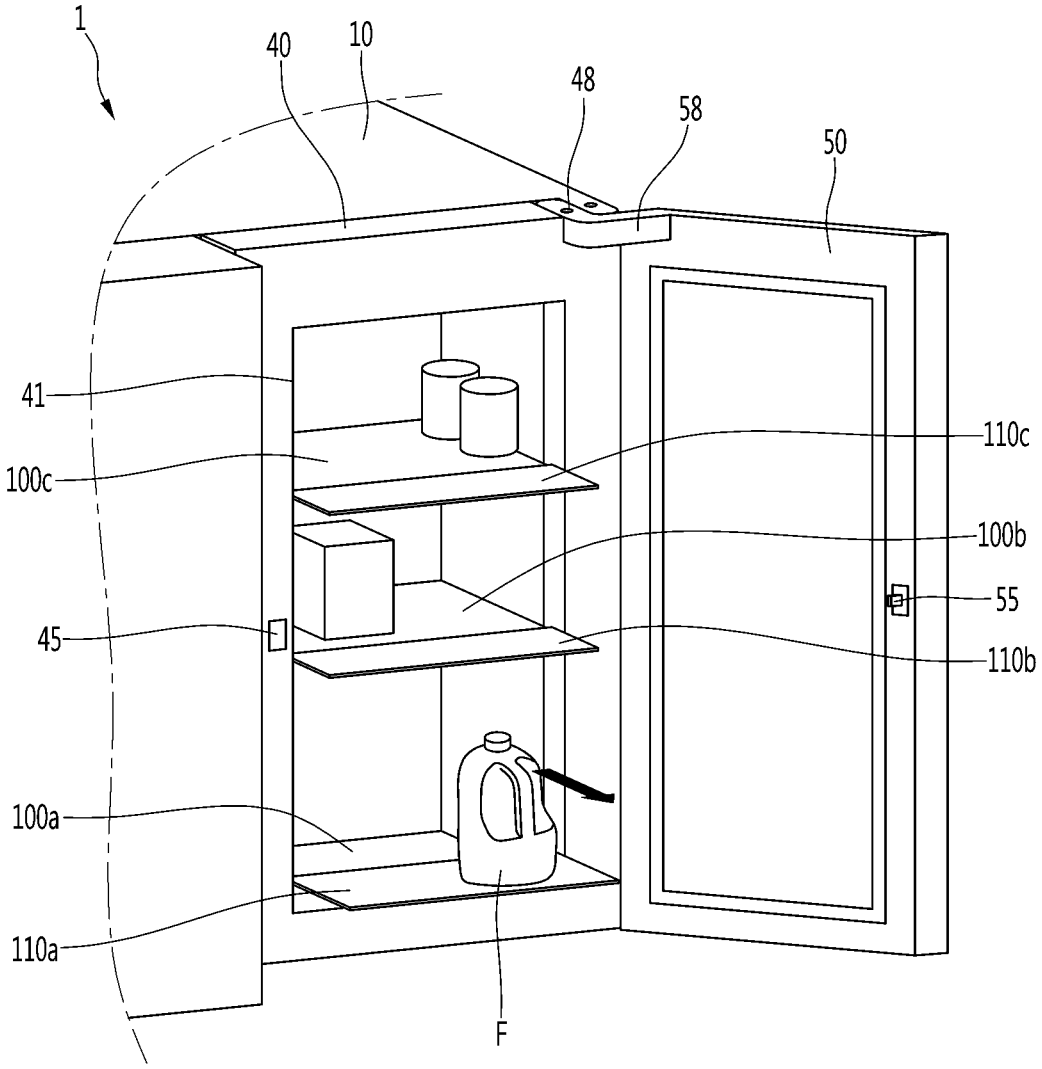
FIG. 3 is a perspective view illustrating a state in which a shelf guard rotates when the sub door is opened according to an embodiment.

FIG. 1 is a perspective view illustrating constituents of a refrigerator according to an embodiment, FIG. 2 is a perspective view illustrating constituents of a main door and a sub door according to an embodiment, and FIG. 3 is a perspective view illustrating a state in which a shelf guard rotates when the sub door is opened according to an embodiment.

Referring to FIGS. 1 to 3, a refrigerator 1 according to an embodiment may include a cabinet 10 provided with a storage compartment therein and doors 20 and 30 provided on a front surface of the cabinet 10 to selectively open or close the storage compartment.

In detail, the storage compartment may include a refrigerating compartment 12 and a freezing compartment 13. The freezing compartment 13 may be provided under the refrigerating compartment 12.

The doors 20 and 30 include a refrigerating compartment door 20 rotatably provided in front of the refrigerating compartment 12 and a freezing compartment door 30 rotatably provided in front of the freezing compartment 13. In another example, the freezing compartment door 30 may be provided as a drawer-type door that is provided to be withdrawable forward.

The refrigerating compartment door 20 is provided in a pair and may be rotatably connected to a left edge and a right edge of the front surface of the cabinet 10, respectively. Such a door may be called a french door.

Recessed handle grooves 25 and 35 may be provided in a lower end of the refrigerating compartment door 20 and an upper end of the freezing compartment door 30, respectively. A user may insert his/her hand into the handle groove 25 or 35 to open or close the refrigerating compartment door 20 or the freezing compartment door 30.

The refrigerating compartment door 20, which is disposed at a right side (when viewed in FIG. 1) of the pair of refrigerating compartment doors 20, may be doubly opened or closed. In detail, the refrigerating compartment door 20 may include a main door 40 that opens or closes the refrigerating compartment 12 and a sub door 50 rotatably disposed on the main door 40 to open or close an opening defined in the main door 40.

The main door 40 may have the same size as that of the refrigerating compartment door 20, which is disposed at the left side (when viewed in FIG. 1), of the pair of refrigerating compartment doors 20. The main door 40 may be rotatably mounted on the cabinet 10 by a main hinge 48 to open at least a portion of the refrigerating compartment 12.

The sub door 50 may be rotatably mounted to the main door 40 by a sub hinge 58. A latch 55 is provided on a rear surface of the sub door 50, and a latch groove 45 into which the latch 55 is inserted is defined in the front surface of the main door 40. When the latch 55 is hooked with the latch groove 45, the sub door 50 may be maintained in a state of being coupled to the main door 40.

The opening 41 that is opened with a predetermined size is defined in the main door 40. A shelf 100 in which food F or a food container is accommodated may be mounted on a rear surface of the main door 40. After opening the sub door 50, a user may access the food F or the food container accommodated in the shelf 100 through the opening 41.

The shelf 100 may be provided in plurality. Here, the plurality of shelves 100 may be arranged to be spaced apart from each other in a vertical direction. The plurality of shelves 100 are arranged to be spaced apart from a lower portion to an upper portion of the opening 41, and the space between two adjacent shelves 100 may be defined as an accommodation space for accommodating the food F.

For example, the plurality of shelves 100 includes a first shelf 100*a*, a second shelf 100*b*, and a third shelf 100*c*. The first to third shelves 100*a*, 100*b*, and 100*c* may be arranged to be spaced upward from the lower portion of the opening 41.

A shelf guard 110 is provided in front of the shelf 100. The shelf guard 110 provides a front protrusion of the shelf 100 and may be configured to extend upward from a front end of the shelf 100. The shelf guard 110 may prevent the food F accommodated in the shelf 100 from falling forward.

The shelf guard 110 are provided in plurality and may be provided in front of the first to third shelves 100*a*, 100*b*, and 100*c*. For example, the plurality of shelf guards 110 includes a first shelf guard 110*a* provided in front of the first shelf 100*a*, a second shelf guard 110*b* provided in front of the second shelf 100*b*, and a third shelf guard 100*c* provided in front of the third shelf 100*c*.

The shelf guard 110 may be provided to be movable. For example, the shelf guard 110 may extend towards a front side.

In detail, an upper portion of the shelf guard 110 may rotate forward with respect to a lower portion of the shelf guard 110. Due to this movement, the shelf guard 110 may extend from and have the same level as the shelf 100 to provide a flat surface with respect to a top surface of the shelf 100. Thus, the shelf guard 110 no longer provides for a front protrusion of the shelf 100.

When the user takes out the food F accommodated in the shelf 100, the user no longer needs to take out the food F by moving forward and tilting the food F so that the food F does not interfere with the shelf guard 110. That is, as illustrated in FIG. 3, the food F or the food container may be easily moved forward along the surface of the shelf guard 110 which is flush with the shelf 100 to be taken out.

The shelf guard 110 may rotate forward when the sub door 50 is opened. For this, a projection 201 may be provided on the sub door 50, and a moving part 210 selectively contacting the projection 201 may be provided on the main door 40 (see FIG. 4).

When the sub door 50 is closed, the projection 201 presses against the moving part 210 to cause the moving part 210 to move backward. As a result, the shelf guard 110 of the shelf 100 may rotate to its previous position to provide a protrusion that stands on the front portion of the shelf 100 as illustrated in FIG. 2.

On the other hand, when the sub door 50 is opened, the projection 201 is spaced apart from the moving part 210, and the moving part 210 is drawn forward. As a result, the shelf guard 110 rotates to the front side of the shelf 100 as illustrated in FIG. 3 and is laid horizontally with the shelf. Therefore, the food or food container accommodated in the shelf 100 may be easily taken out.

In this regard, it will be described in more detail with reference to the drawings.

Figure 4:
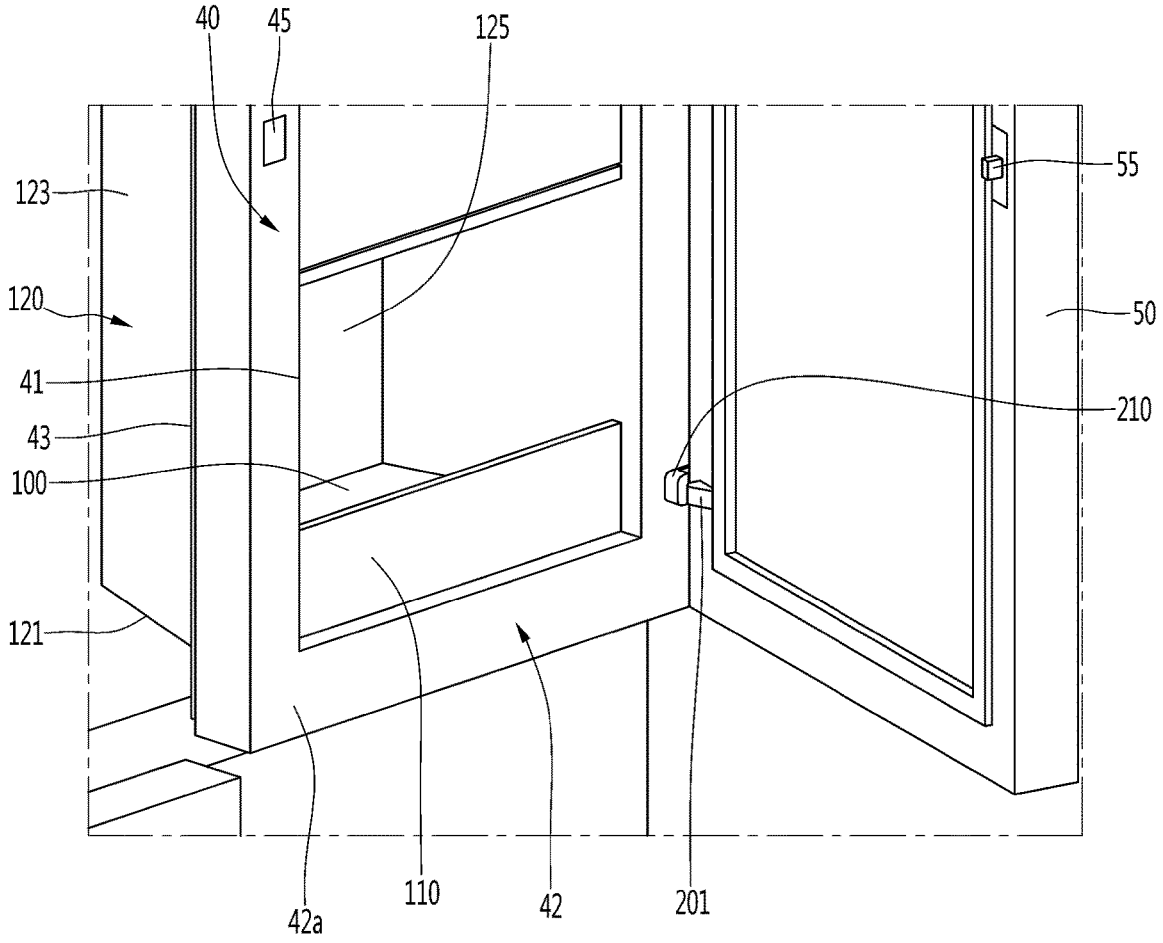
FIG. 4 is a perspective view illustrating constituents of a refrigerator door according to an embodiment.
Figure 5:
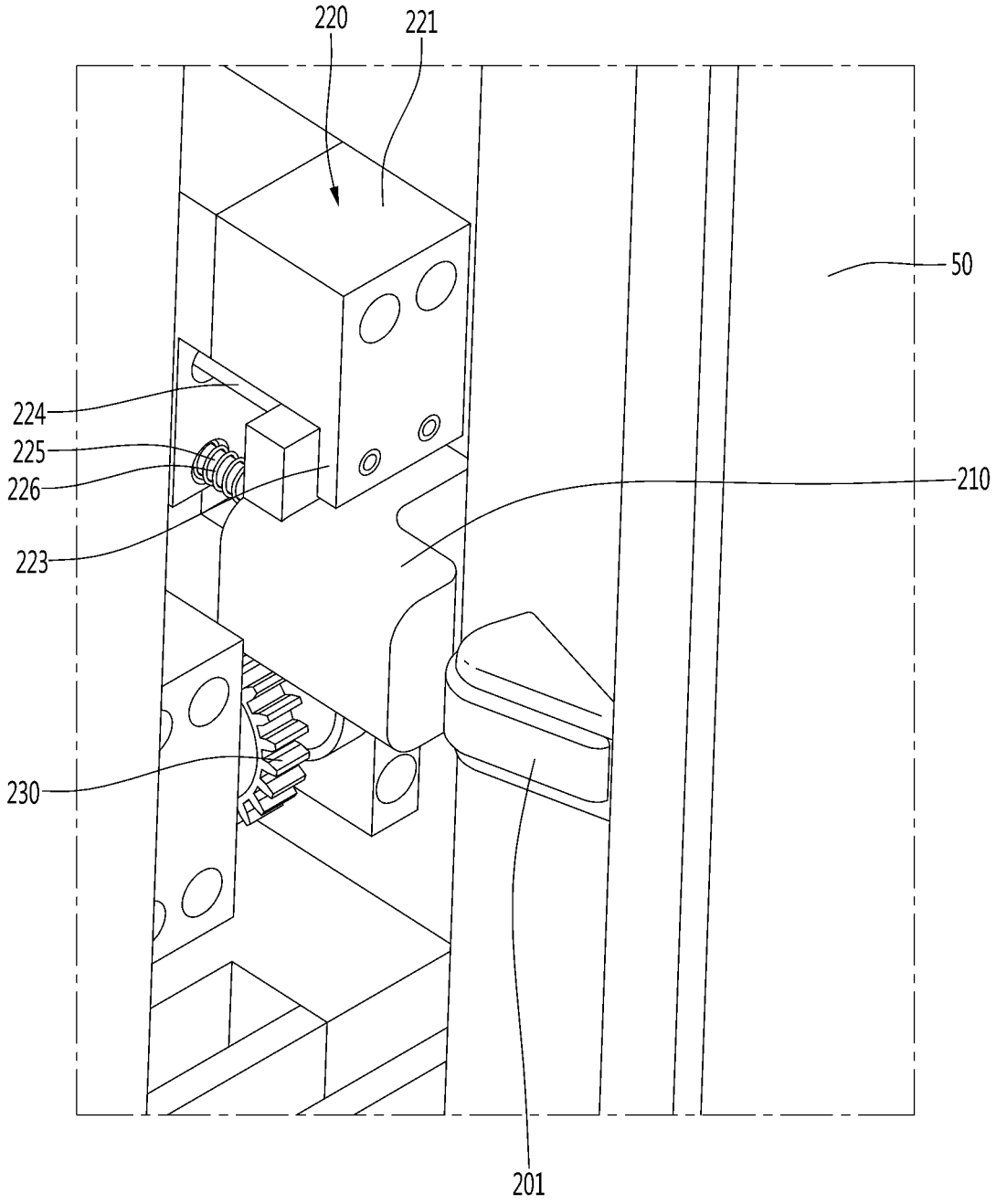
FIG. 5 is a view illustrating a state in which contact between a projection and a moving part is released when the sub door is opened according to an embodiment.
Figure 6:
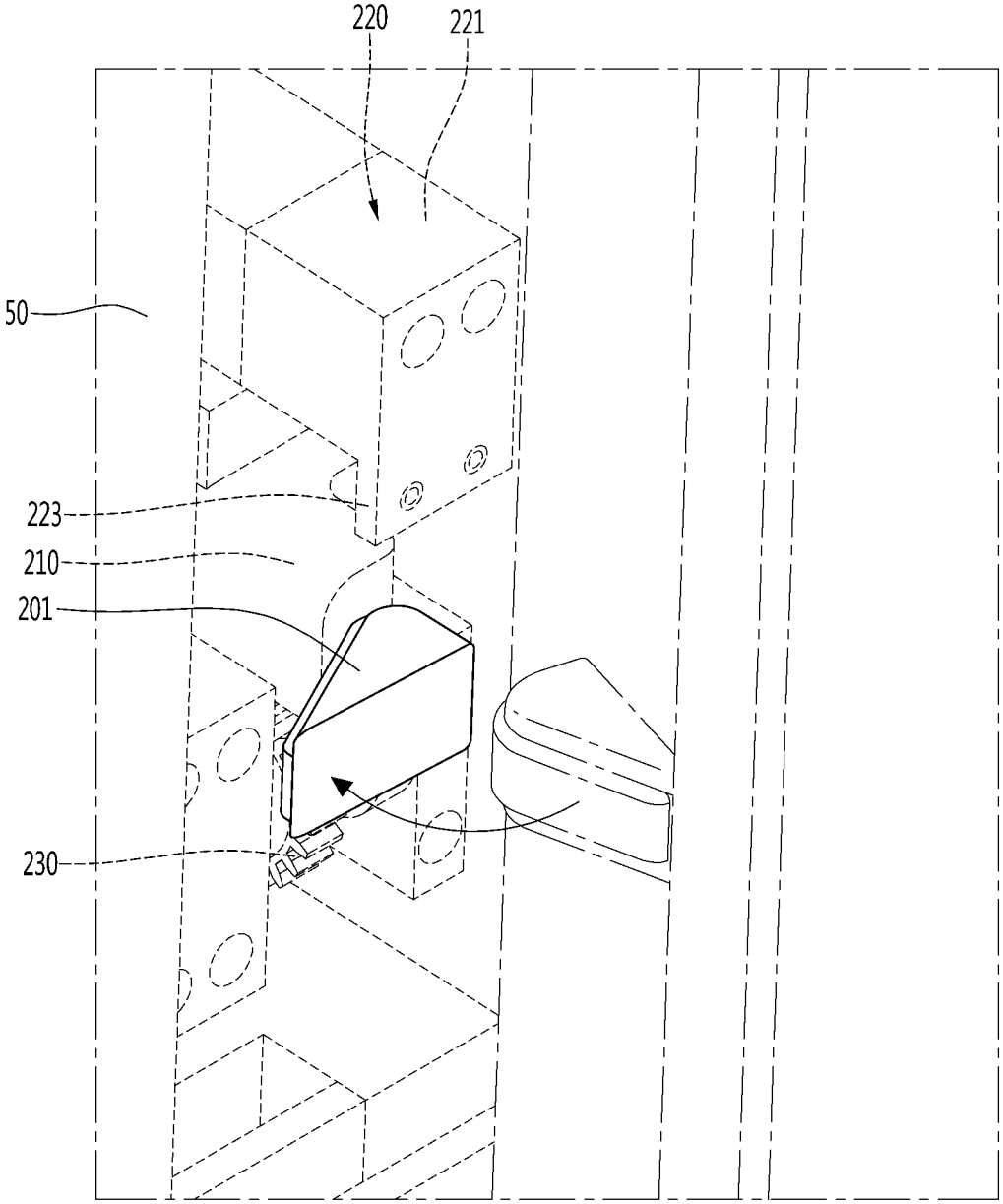
FIG. 6 is a view illustrating a state in which the projection and the moving part contact each other when the sub door is closed according to an embodiment.

FIG. 4 is a perspective view illustrating constituents of the refrigerator door according to an embodiment, FIG. 5 is a view illustrating a state in which contact between the projection and the moving part is released when the sub door is opened according to an embodiment, and FIG. 6 is a view illustrating a state in which the projection and the moving part contact each other when the sub door is closed according to an embodiment.

Referring to FIGS. 4 to 6, the main door 40 according to an embodiment includes an outer part 42 defining outer appearances of front and lateral surfaces of the main door 40 and a door liner 43 mounted on a rear surface of the outer part 42.

The outer part 42 is configured to include a front surface and two lateral surfaces and may have a shape that is bent in a "ㄷ" shape. Also, the door liner 43 may be provided to cover an opened rear side of the outer part 42.

In the closed state of the main door 40, an edge of the door liner 43 is in close contact with the front surface of the cabinet 10. In the closed state of the sub door 50, an edge of a rear surface of the sub door 50 may be in close contact with the front surface of the outer part 42 of the main door 40.

A housing 120 defining an accommodation space for the food or the food container may be mounted at a rear side of the main door 40. The housing 120 may be provided behind the door liner 43.

The housing 120 includes a housing bottom surface 121, two housing lateral surface 123 extending upward from both sides of the housing bottom surface 121, and a housing rear surface 125 connecting the two housing lateral surfaces 123 to each other to define an outer appearance of a rear side of the housing 120.

The housing bottom surface 121, the housing lateral surface 123, and the housing rear surface 125 define the accommodation space of the food or the food container. The plurality of shelves 100 may be provided in the accommodation space.

The lowermost shelf of the plurality of shelves 100 may be placed on the housing bottom surface 121. Alternatively, the housing bottom surface 121 itself may constitute the lowermost shelf.

The outer part 42 of the main door 40 includes a front surface 42*a* that is in contact with the rear surface of the sub door 50. The opening 41 may be defined in the front surface 42*a*, and the sub door 50 may shield the opening 41.

The main door 40 with the sub door 50 may include a rotation guide device for allowing the shelf guard 110 to rotate. The rotation guide device includes a projection 201 and a moving part 210.

The projection 201 is provided on the rear surface of the sub door 50 and may be provided to protrude backward. For example, the projection 201 may be disposed at the rear surface of the sub door 50.

The moving part 210 may be provided on the front surface 42*a* of the outer part 42 to move forward or backward. The moving part 210 may be in contact with the projection 201.

The rotation guide device further includes a support bracket 220 that movably supports the moving part 210. The support bracket 220 is provided behind the front surface 42*a* of the outer part 42.

The support bracket 220 includes a bracket body 221 fixed inside a lateral surface of the outer part 42. The bracket body 221 may have a substantially hexahedral shape.

A stopper 223 that restricts an advancing distance of the moving part 210 is provided at a lower portion of the bracket body 221. The stopper 223 is configured to protrude downward from a lower end of the bracket body 221 and may be provided to be in contact with a front surface of the moving part 210. In the process in which the moving part 210 moves forward, if the front surface of the moving part 210 interferes with the stopper 223, the moving part 210 may be prevented from advancing further forward.

The support bracket 220 further includes bracket guides 224 and 225 that guide the forward and backward movement of the moving part 210. Each of the bracket guides 224 and 225 may have a bar shape, be configured to extend forward and backward, and pass through the moving part 210 or be inserted into the moving part 210.

The bracket guides 224 and 225 include a first bracket guide 224 passing through the moving part 210. The first bracket guide 224 is configured to connect a front portion to a rear portion of the bracket body 221.

In detail, the front portion and the rear portion of the bracket body 221 may be spaced apart from each other, and an upper portion of the moving part 210 may move in a space between the front portion and the rear portion of the bracket body. The first bracket guide 224 pass through the moving part 210 to extend from the front portion to the rear portion of the bracket body 221, thereby guiding the moving part 210 so that the moving part 210 stably moves forward and backward without being shaken to the left and right sides.

The first bracket guide 224 may be provided in plurality, and the plurality of first bracket guides 224 may be arranged in a left and right direction.

The bracket guides 224 and 225 further include a second bracket guide 225 connected to a rear portion of the bracket body 221 to extend forward so as to be inserted into the moving part 210. An insertion groove defined in the moving part 210 may be longer than an inserted depth of the second bracket guide 225. Thus, when the moving part 210 moves forward and backward, the second bracket guide 225 may move inside the insertion groove of the moving part 210.

A bracket spring 226 providing restoring force to the moving part 210 may be provided between the rear portion of the bracket body 221 and the moving part 210. The bracket spring 226 includes a coil spring. For example, the bracket spring 226 may be provided as a compression spring.

The second bracket guide 225 may be inserted into the bracket spring 226. That is, since the bracket spring 226 is provided to surround the second bracket guide 225, the bracket spring 226 may be prevented from being deformed in a lateral direction when the bracket spring 226 is tensioned or contracted.

The rotation guide device further includes a first gear assembly 230 interlocked with the moving part 210. The moving part 210 and the first gear assembly 230 may be interlocked with each other. When the moving part 210 moves forward or backward, the first gear assembly 230 may rotate.

Referring to FIG. 5, when the sub door 50 rotates forward to open the opening 41, the projection 201 is spaced apart from the moving part 210. Thus, the pressing state of the projection 201 against the moving part 210 is released, and the moving part 210 advances forward by the restoring force of the bracket spring 226.

As the moving part 210 advances, the first gear assembly 230 rotates in a clockwise direction (based on FIG. 5), and the shelf guard 110 interlocked with the first gear assembly 230 as illustrated in FIG. 3 rotates forward and then is arranged to be in parallel to the shelf 100.

Referring to FIG. 6, when the sub door 50 rotates backward to shield the opening 41, the projection 201 may contact the moving part 210 to allow the projection 201 to press against the moving part 210. The moving part 210 overcomes the restoring force of the bracket spring and is withdrawn backward.

The first gear assembly 230 may rotate in a counterclockwise direction (based on FIG. 6) according to the withdrawal of the moving part 210, and the shelf guard 110 interlocked with the first gear assembly 230 rotates backward as illustrated in FIG. 2, thereby providing a protrusion with respect to the shelf 100.

Hereinafter, constituents of the rotation guide device will be described in more detail with reference to the drawings.

Figure 7:
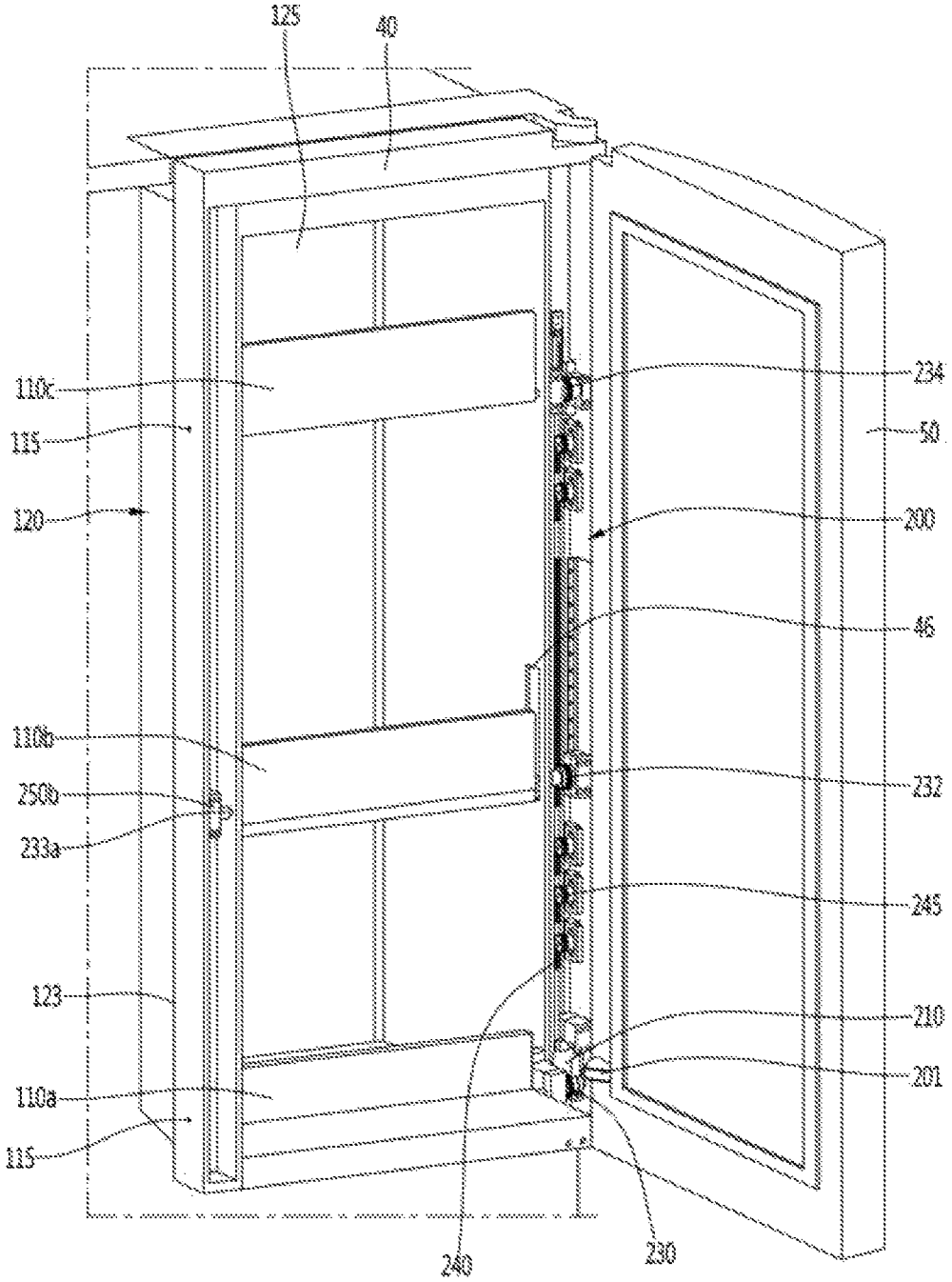
FIG. 7 is a view illustrating a rotation guide device of the shelf guard according to an embodiment.
Figure 8:
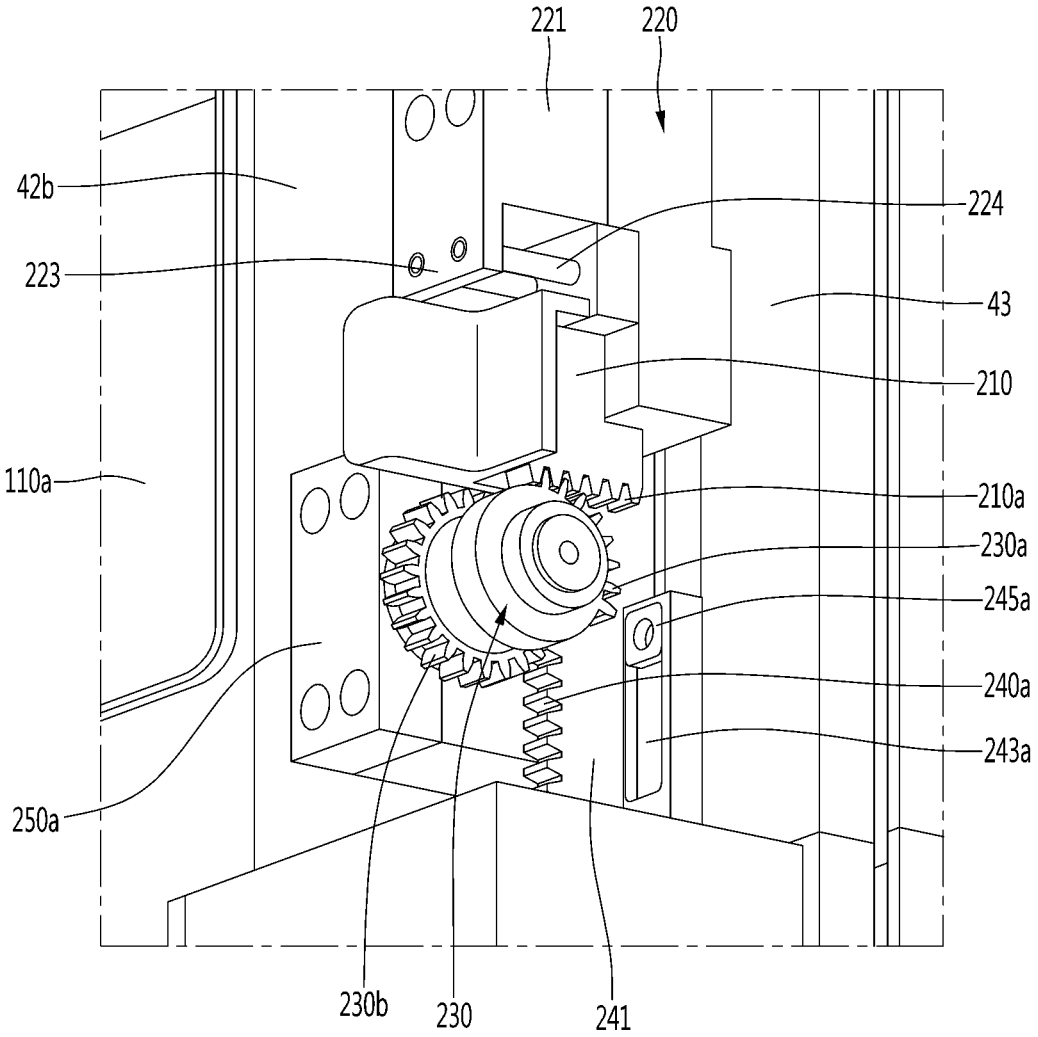
FIG. 8 is a view illustrating some of constituents of a rotation guide device provided at a side of a first shelf guard according to an embodiment.
Figure 9:
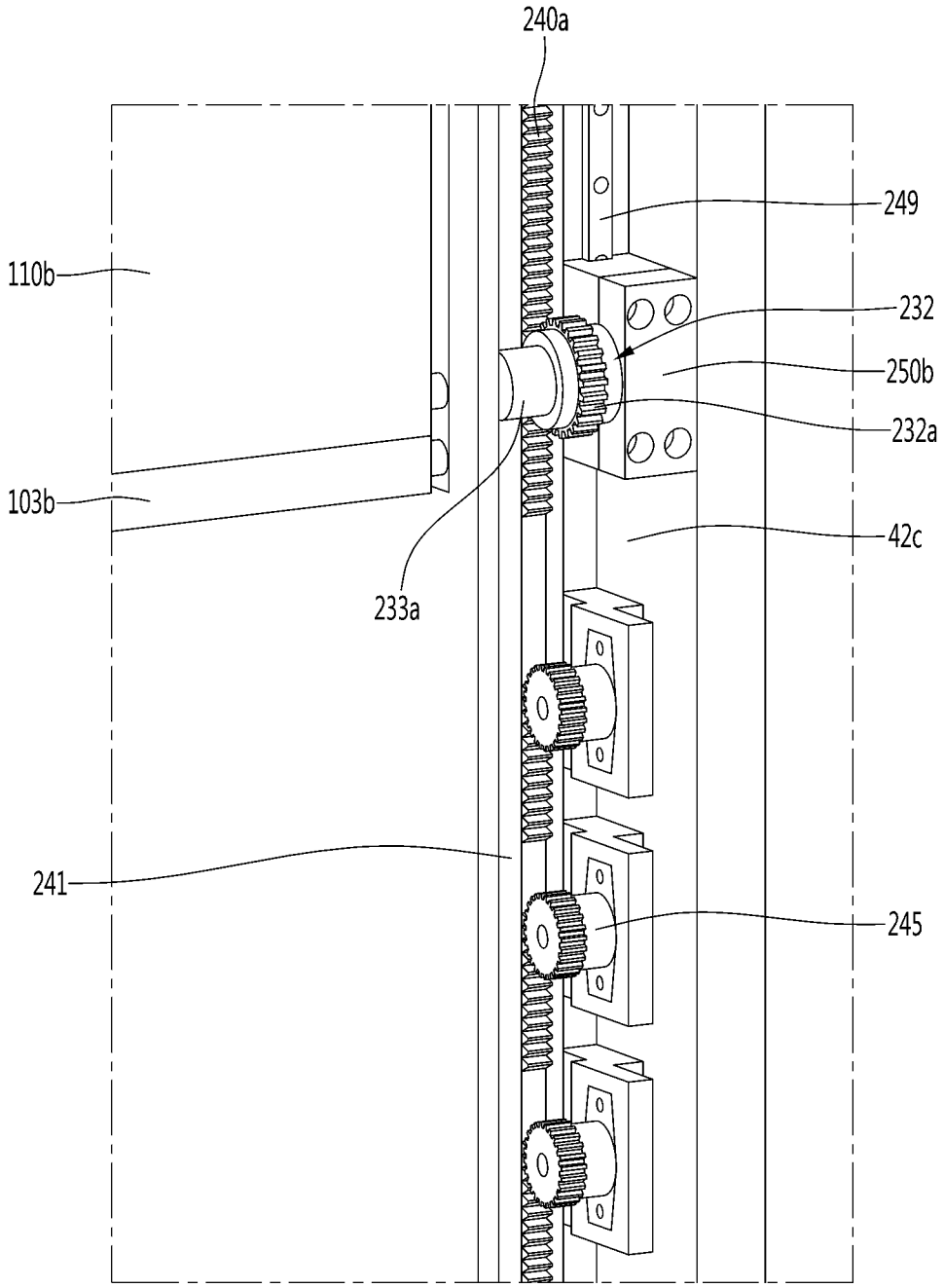
FIG. 9 is a view illustrating some of constituents of a rotation guide device provided at a side of a second shelf guard according to an embodiment.
Figure 10:
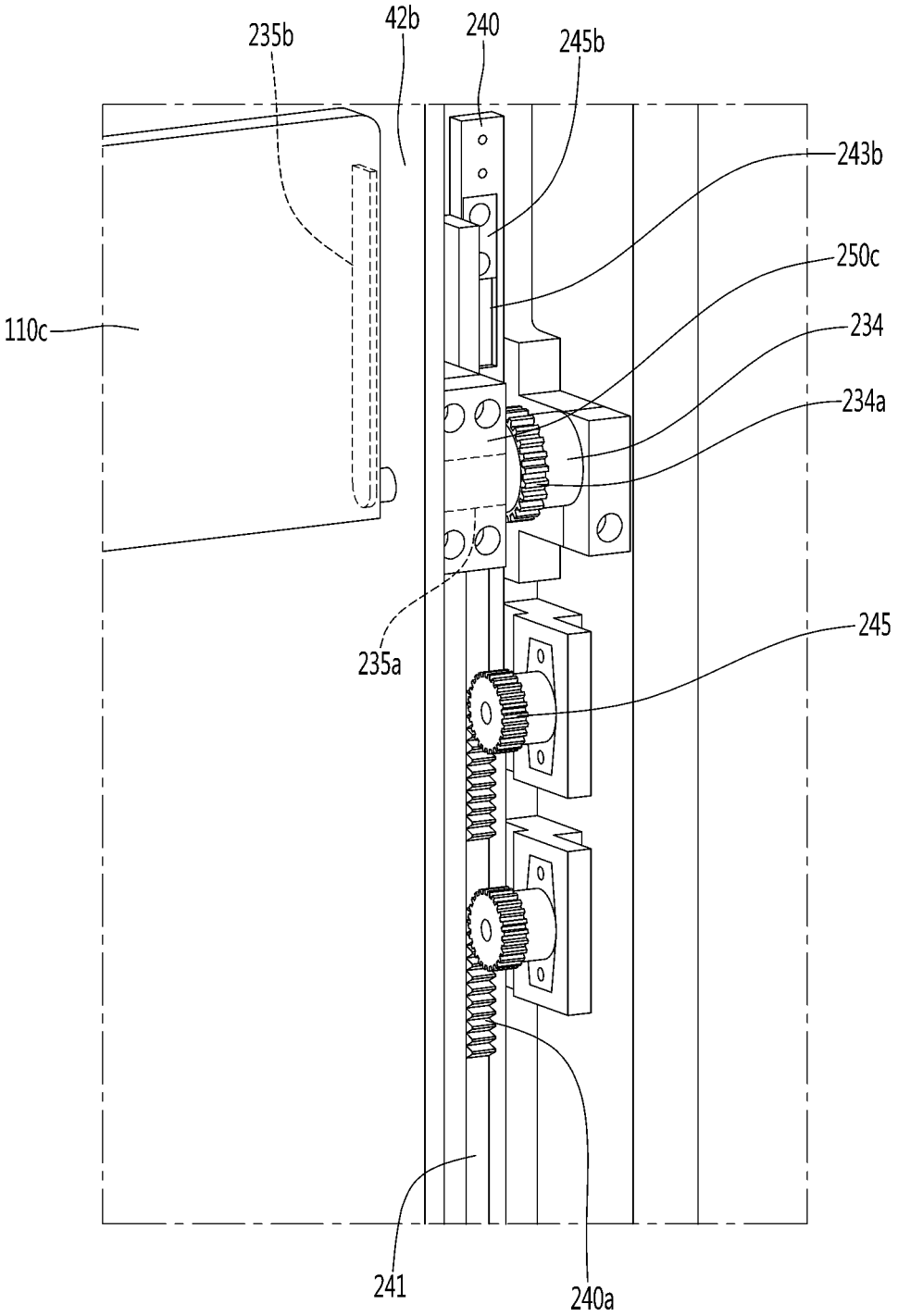
FIG. 10 is a view illustrating some of constituents of a rotation guide device provided at a side of a third shelf guard according to an embodiment.
Figure 11:
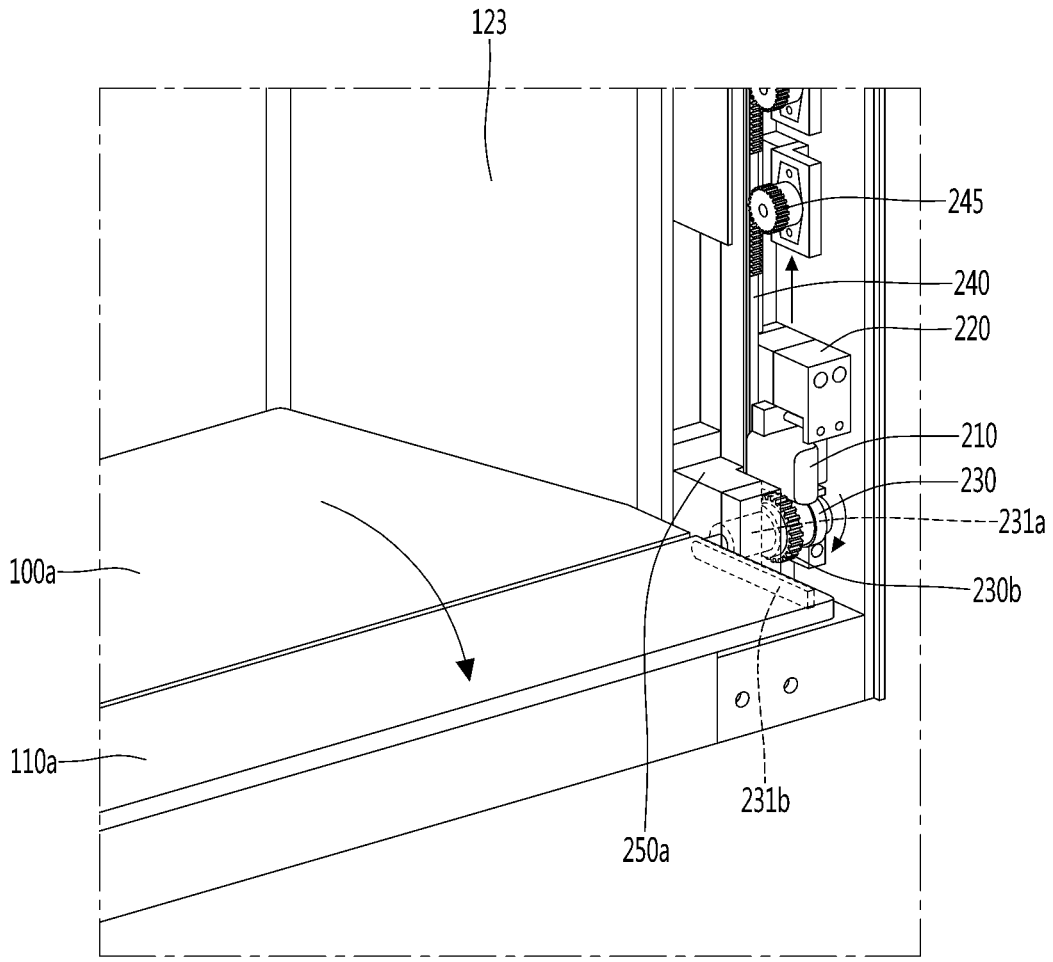
FIG. 11 is a view illustrating a state in which the shelf guard rotates according to an embodiment.

FIG. 7 is a view illustrating the rotation guide device of the shelf guard according to an embodiment, FIG. 8 is a view illustrating some of constituents of a rotation guide device provided at a side of the first shelf guard according to an embodiment, FIG. 9 is a view illustrating some of constituents of a rotation guide device provided at a side of the second shelf guard according to an embodiment, FIG. 10 is a view illustrating some of constituents of a rotation guide device provided at a side of the third shelf guard according to an embodiment, and FIG. 11 is a view illustrating a state in which the shelf guard rotates according to an embodiment.

Referring to FIGS. 7 to 11, the main door 40 according to an embodiment includes a rotation guide device 200 for allowing the shelf guards 110*a*, 110*b* and 110*c* to rotate. The rotation guide device 200 may be provided inside the outer part 42 of the main door 40, i.e., in an inner space defined by a front surface 42*a* and two lateral surfaces 42*b* and 42*c*.

The rotation guide device 200 includes the above-described projection 201, the above-described moving part 210, and a first gear assembly 230.

The first gear assembly 230 may be understood as a constituent for allowing the first shelf guard 110*a* of the plurality of shelf guards 110*a*, 110*b*, and 110*c* to rotate. The first gear assembly 230 may be rotatably supported by a first gear bracket 250*a*. The first gear bracket 250*a* may be coupled to a first lateral surface 42*b* of the outer part 42. The first lateral surface 42*b* may be understood as a portion of a lateral surface defining the opening 41.

The moving part 210 includes a first rack gear 210*a*. The first rack gear 210*a* is disposed on a bottom surface of the moving part 210 and may be provided in a front and rear direction. The first rack gear 210*a* has a plurality of gear teeth.

The first gear assembly 230 includes a first pinion gear 230*a* interlocked with the first rack gear 210*a* and having a plurality of gear teeth. With the first pinion gear 230*a* interlocked with the first rack gear 210*a*, the first pinion gear 230*a* may rotate in the clockwise or counterclockwise direction with respect to a central axis that is defined in the left and right direction.

The first gear assembly 230 includes a second pinion gear 230*b* having a plurality of gear teeth. The second pinion gear 230*b* may be coupled to or integrated with the first pinion gear 230*a*. Therefore, the first and second pinion gears 230*a* and 230*b* may rotate together. For example, the first and second pinion gears 230*a* and 230*b* may be arranged in the left and right direction.

The first gear assembly 230 further includes a connection cylinder 231*a* extending from the second pinion gear 230*b* toward the first shelf guard 110*a*. The connection cylinder 231*a* may be inserted into the first gear bracket 250*a*.

The first gear assembly 230 further includes a connection bar 231*b* extending from the connection cylinder 231*a* and coupled to the first shelf guard 110*a*. The connection bar 231*b* may extend by being bent from the connection cylinder 231*a* and may be coupled to a first lateral surface of the first shelf guard 110*a*. For example, the connection bar 231*b* may be inserted into the first shelf guard 110*a* and coupled to the first lateral surface of the first shelf guard 110*a*.

When the first and second pinion gears 230*a* and 230*b* rotate, the connection cylinder 231*a* and the connection bar 231*b* rotate together with the first and second pinion gears 230*a* and 230*b* to allow the first shelf guard 110*a* to rotate.

A hinge shaft 115 is connected to a second lateral surface of the first shelf guard 110*a*. The hinge shaft 115 may be coupled to the outer part 42. That is, the first shelf guard 110*a* may have a width corresponding to a width of the opening 41 in the left and right direction of the opening 41 and be rotatably supported on lateral surfaces of the outer part 42, which define both lateral surfaces of the opening 41.

The first lateral surface of the first shelf guard 110*a* may be rotated by the first gear assembly 230, and the second lateral surface opposite to the first lateral surface with respect to the opening 41 may be coupled to the hinge shaft 115 and supported on the outer part 42.

The first gear assembly 230 and the hinge shaft 115 are connected to a lower portion of the first shelf guard 110*a*. Thus, when the first gear assembly 230 rotates, the first shelf guard 110*a* rotates in a top and down manner in which an upper portion of the first shelf guard 110*a* rotates downward with respect to a lower portion of the first shelf guard 110*a* between the first gear assembly 230 and the hinge shaft 115.

The rotation structure of the first shelf guard 110*a* is equally applied to the third shelf guard 110*c*. That is, the third shelf guard 110*c* may be configured to rotate in the top and down manner between the third gear assembly 234 and the hinge shaft.

The rotation guide device 200 further includes a second rack gear 240 interlocked with the second pinion gear 230*b*. The second rack gear 240 may extend lengthily in the vertical direction from a side of the opening 41. For example, the second rack gear 240 may extend upward from a height corresponding to the first shelf guard 110*a* to a height corresponding to the third shelf guard 110*c*.

The second rack gear 240 may move in the vertical direction. In detail, the second rack gear 240 may be movably supported on the door liner 43.

The rotation guide device 200 includes a first guide pin 245*a* coupled to the door liner 43. The first guide pin 245*a* may be inserted into a first guide hole 243*a* of the second rack gear 240.

The second rack gear 240 includes a gear body 241 extending lengthily in the vertical direction. A plurality of gear teeth 240*a* interlocked with the gear teeth of the second pinion gear 230*b* are disposed on a front surface of the gear body 241.

The second rack gear 240 defines a first guide hole 243*a* through which a portion of the gear body 241 passes forward and backward. The first guide hole 243*a* may be defined under the second rack gear 240 and also may be defined in the vertical direction.

Since the first guide pin 245*a* is in the state of being inserted into the first guide hole 243*a*, the second rack gear 240 may be supported on the first guide pin 245*a* without being shaken in the left and right direction when moving in the vertical direction. When the first guide pin 245*a* interferes with an upper or lower end of the first guide hole 243*a*, further movement of the second rack gear 240 may be restricted.

A second gear assembly 232 may be provided at a height corresponding to the second shelf guard 110*b* of the plurality of shelf guards 110. The second gear assembly 232 may be rotatably supported on the second gear bracket 250*b*.

In detail, a gear shaft 232*b* (see FIG. 13) of the second gear assembly 232 may be inserted into the second gear bracket 250*b*.

The second gear bracket 250*b* may be provided inside the second lateral surface 42*c* of the outer part 42. Also, the second gear bracket 250*b* may move in the vertical direction along a bracket rail 249. The bracket rail 249 is a constituent of the device for adjusting the height of the second shelf 232 and may be arranged to be inserted into a rail groove of the second gear bracket 250*b*, which will be described in more detail further below.

The second gear assembly 232 may be interlocked with the second rack gear 240. The plurality of gear teeth 240*a* disposed on the second rack gear 240 may be provided at a position corresponding to the second gear assembly 232. In summary, some of the gear teeth 240*a* may be disposed in the vertical direction of the second rack gear 240 and may be disposed at positions corresponding to the first gear assembly 230, the second gear assembly 232, and the third gear assembly 234.

The second gear assembly 232 includes a pinion gear 232*a* interlocked with the gear teeth 240*a* of the second rack gear 240.

The second gear assembly 232 may be separated from the second rack gear 240 when the second shelf 100*b* and the second shelf guard 110*b* move in the vertical direction so as to adjust a height thereof. Further description will be provided further below.

The second gear assembly 232 further includes a connection cylinder 233*a* extending from the pinion gear 232*a* towards the second shelf guard 110*b*.

The second gear assembly 232 further includes a connection bar 233*b* extending from the connection cylinder 233*a* and coupled to the second shelf guard 110*b*. The connection bar 233*b* may extend by being bent from the connection cylinder 233*a* and may be coupled to a first lateral surface of the second shelf guard 110*b*. For example, the connection bar 233*b* may be inserted into the second shelf guard 110*b* and coupled to the first lateral surface of the second shelf guard 110*b*.

Figure 12:
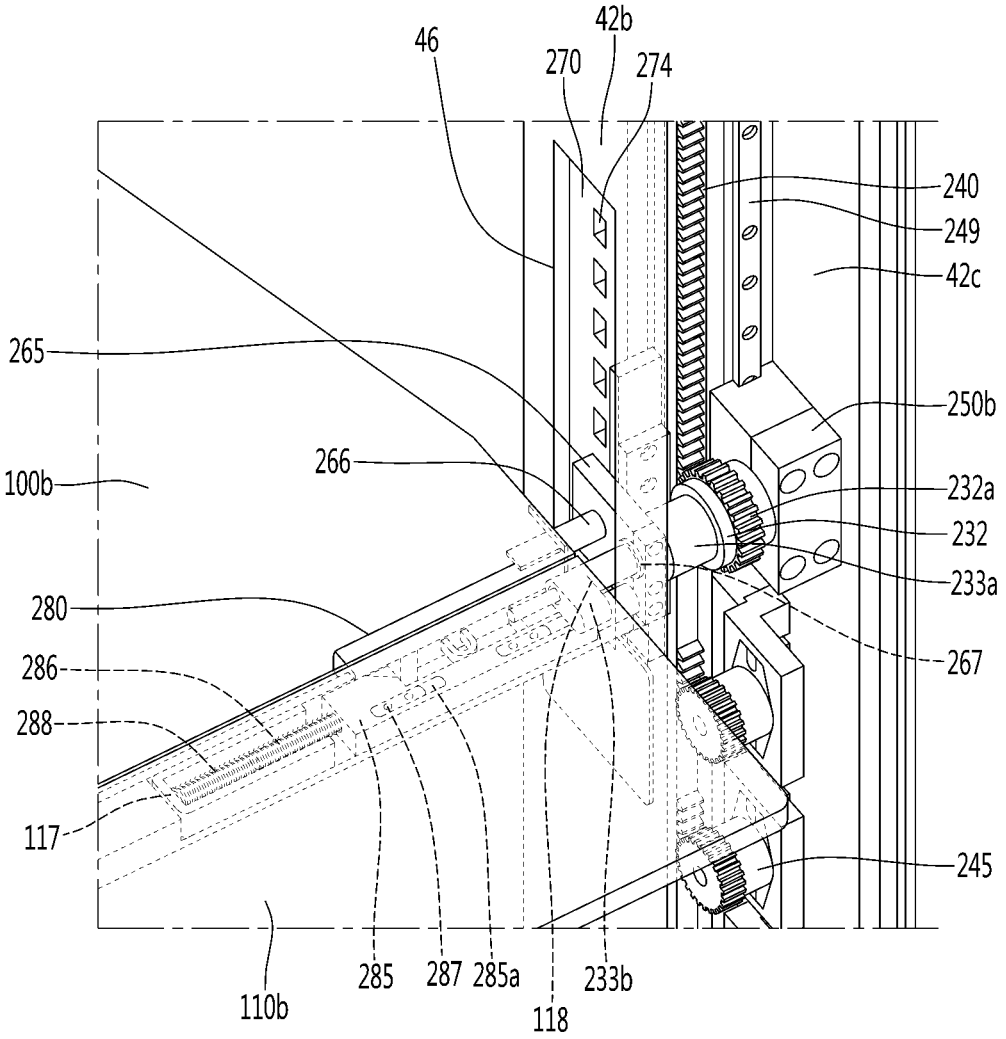
FIG. 12 is a view illustrating a device for adjusting a vertical height of the shelf according to an embodiment.

A bar insertion portion 118 into which the connection bar 233*b* is inserted may be defined in the second shelf guard 110*b*, and the connection bar 233*b* may move in the left and right direction within the bar insertion portion 118 (see FIG. 12).

The connection bar 233*b* may also be coupled to the second lateral surface facing the first lateral surface of the second shelf guard 110*b*. Also, the connection cylinder 233*a* may be connected to the connection bar 233*b* coupled to the second lateral surface of the second shelf guard 110*b*, and the connection cylinder 233*a* may be rotatably supported on the second gear bracket 250*b*. However, the pinion gear may not be provided on the second lateral surface of the second shelf guard 110*b*.

When the second rack gear 240 moves in the vertical direction to allow the pinion gear 232*a* to rotate, the connection cylinder 233*a* and the connection bar 233*b* may rotate together with the pinion gear 232*a* to allow the second shelf guard 110*b* to rotate.

The second shelf 100*b* includes a shelf front surface 103*b* having a predetermined height in the vertical direction. A device for adjusting a height of the second shelf 100*b* may be installed inside the shelf front surface 103*b* (see FIG. 12).

The third gear assembly 234 may be provided at a height corresponding to the third shelf guard 110*c* of the plurality of shelf guards 110. The third gear assembly 234 may be rotatably supported on the third gear bracket 250*c*.

The third gear bracket 250*c* may be provided inside the first lateral surface 42*b* of the outer part 42. The configuration and installation position of the third gear bracket 250*c* are substantially the same as the configuration and installation position of the first gear bracket 250*a*.

The third gear assembly 234 may be interlocked with the second rack gear 240. The gear teeth of some of the plurality of gear teeth 240*a* disposed on the second rack gear 240 may be provided at positions corresponding to the third gear assembly 234.

A second guide hole 243*b* may be defined in an upper portion of the second rack gear 240, and a second guide pin 245*b* may be inserted into the second guide hole 243*b*. The second guide pin 245*b* may be coupled to the door liner 43.

Since the second guide pin 243*b* is in the state of being inserted into the second guide hole 243*b*, the second rack gear 240 may be supported on the second guide pin 245*b* without being shaken in the left and right direction when moving in the vertical direction.

The third gear assembly 234 includes a pinion gear 234*a* interlocked with the gear teeth 240*a* of the second rack gear 240.

The third gear assembly 234 further includes a connection cylinder 235*a* extending from the pinion gear 234*a* towards the third shelf guard 110*c*. The connection cylinder 235*a* may be inserted into the third gear bracket 250*c*.

The third gear assembly 234 further includes a connection bar 235*b* extending from the connection cylinder 235*a* and coupled to the third shelf guard 110*c*. The connection bar 235*b* extends by being bent from the connection cylinder 235*a* and may be coupled to the first lateral surface of the third shelf guard 110*c*. For example, the connection bar 235*b* may be inserted into the third shelf guard 110*c* and coupled to the first lateral surface of the third shelf guard 110*c*.

When the pinion gear 234*a* rotates, the connection cylinder 235*a* and the connection bar 235*b* may rotate together with the pinion gear 234*a* to allow the third shelf guard 110*c* to rotate.

The hinge shaft 115 is connected to the second lateral surface of the third shelf guard 110*c*. The hinge shaft 115 may be coupled to the outer part 42. That is, the third shelf guard 110*c* may have a width corresponding to a width of the opening 41 in the left and right direction of the opening 41 and be rotatably supported on lateral surfaces of the outer part 42, which define both lateral surfaces of the opening 41.

The third lateral surface of the third shelf guard 110*c* may be rotated by the third gear assembly 234, and the second lateral surface opposite to the first lateral surface with respect to the opening 41 may be coupled to the hinge shaft 115 and supported on the outer part 42.

The third gear assembly 234 and the hinge shaft 115 are connected to a lower portion of the third shelf guard 110*c*. Thus, when the third gear assembly 234 rotates, the third shelf guard 110*c* rotates in the top and down manner in which an upper portion of the third shelf guard 110*c* rotates downward with respect to a lower portion of the third shelf guard 110*c* between the third gear assembly 234 and the hinge shaft 115.

The rotation guide device 200 further includes a reduction gear 245 provided on the second lateral surface 42*c* of the outer part 42 to reduce a moving speed of the second rack gear 240. The reduction gear 245 may be interlocked with the second rack gear 240.

The reduction gear 245 may be provided in plurality, and the plurality of reduction gears 245 may be disposed to be spaced apart from each other in the vertical direction. The plurality of reduction gears 245 may be interlocked with some of the gear teeth 240*a* of the second rack gear 240.

That is, the plurality of gear teeth 240*a* of the second rack gear 240 may be disposed at positions corresponding to the first to third gear assemblies 230, 232, and 234 and disposed at positions corresponding to the plurality of reduction gears 245.

Referring to FIG. 11, an operation of the rotation guide device 200 will be described.

When the sub door 50 is opened, the first to third shelf guards 110*a*, 110*b*, and 110*c* may rotate forward together.

In detail, when the sub door 50 is opened, the moving part 210 advances forward, and the first rack gear 210*a* and the first pinion gear 230*a* that are interlocked with each other allow the first gear assembly 230 to rotate. According to the rotation of the first gear assembly 230, the connection cylinder 231*a* and the connection bar 231*b* may rotate to allow the first shelf guard 110*a* to rotate.

The upper portion of the first shelf guard 110*a* may rotate downward with respect to the lower portion of the first shelf guard 110*a*. Thus, the first shelf guard 110*a* may extend forward from the first shelf guard 110*a*, and a top surface of the first shelf 100*a* and a top surface of the first shelf guard 110*a* may be approximately in the same plane. Thus, the user may conveniently take out the food or the food container accommodated in the first shelf 100*a* along the top surface of the first shelf guard 110*a*.

When the first gear assembly 230 rotates, the second pinion gear 230*b* also rotates. The second pinion gear 230*b* is interlocked with the second rack gear 240, and as a result, the second rack gear 240 may move upward.

The upward moving speed of the second rack gear 240 may be reduced by the plurality of reduction gears 245.

When the second rack gear 240 moves upward, the second rack gear 240 and the pinion gear 232*a* of the second gear assembly 232 are interlocked with each other. As a result, the connection bar 233*b* of the second gear assembly 232 rotates to allow the second shelf guard 110*b* to rotate.

An upper portion of the second shelf guard 110*b* may rotate downward with respect to a lower portion of the second shelf guard 110*b*, like the first shelf guard 110*a*. Thus, the second shelf guard 110*b* may extend forward from the second shelf guard 110*b*, and a top surface of the second shelf 100*b* and a top surface of the second shelf guard 110*b* may be approximately in the same plane. Thus, the user may conveniently take out the food or the food container accommodated in the second shelf 100*b* along the top surface of the second shelf guard 110*b*.

When the second rack gear 240 moves upward, the second rack gear 240 and the pinion gear 234*a* of the third gear assembly 234 are interlocked with each other. As a result, the connection bar 235*b* of the third gear assembly 234 rotates to allow the third shelf guard 110*c* to rotate.

An upper portion of the third shelf guard 110*c* may rotate downward with respect to a lower portion of the third shelf guard 110*c*, like the first and second shelf guards 110*a* and 110*b*. Thus, the third shelf guard 110*c* may extend forward from the third shelf guard 110*c*, and a top surface of the third shelf 100*c* and a top surface of the third shelf guard 110*c* may be approximately in the same plane. Thus, the user may conveniently take out the food or the food container accommodated in the third shelf 100*c* along the top surface of the third shelf guard 110*c*.

Figure 13:
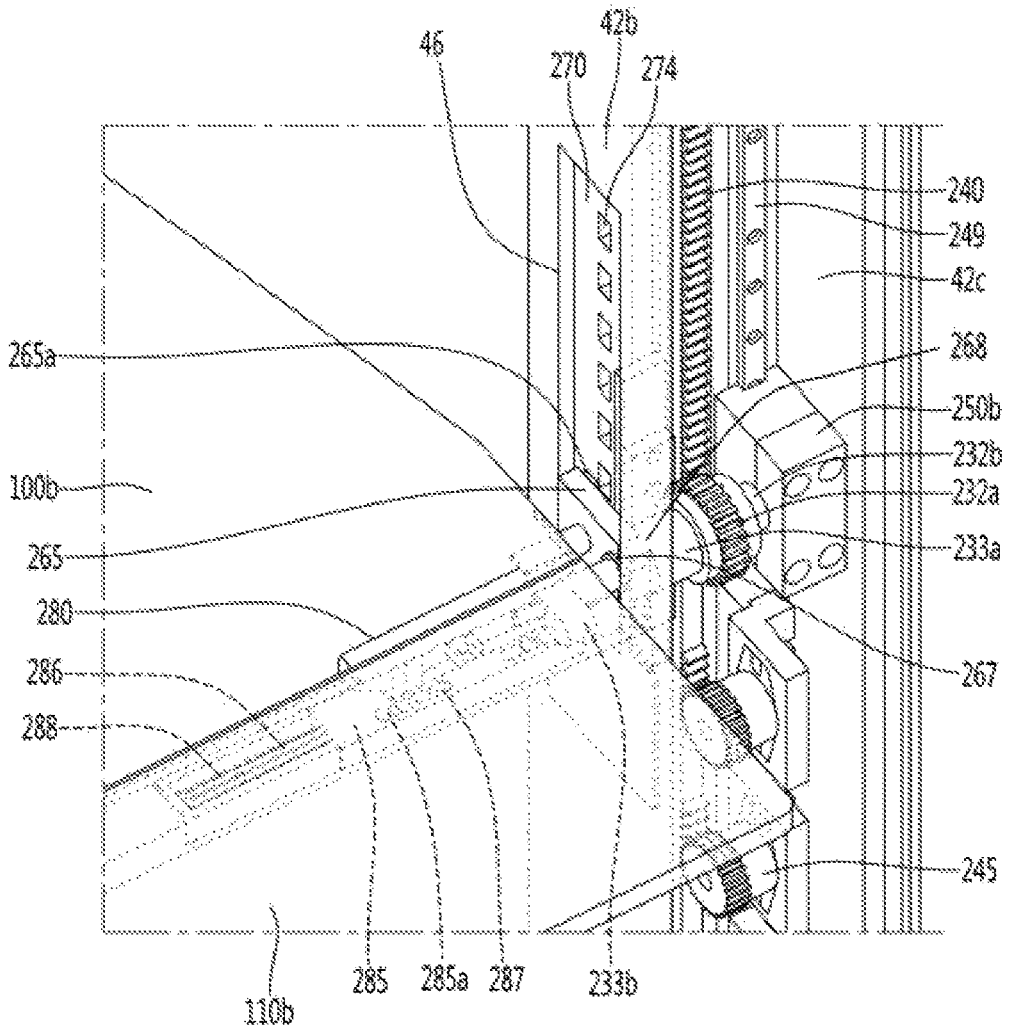
FIG. 13 is a view illustrating a state in which the shelf supported on a door is separated.
Figure 14:
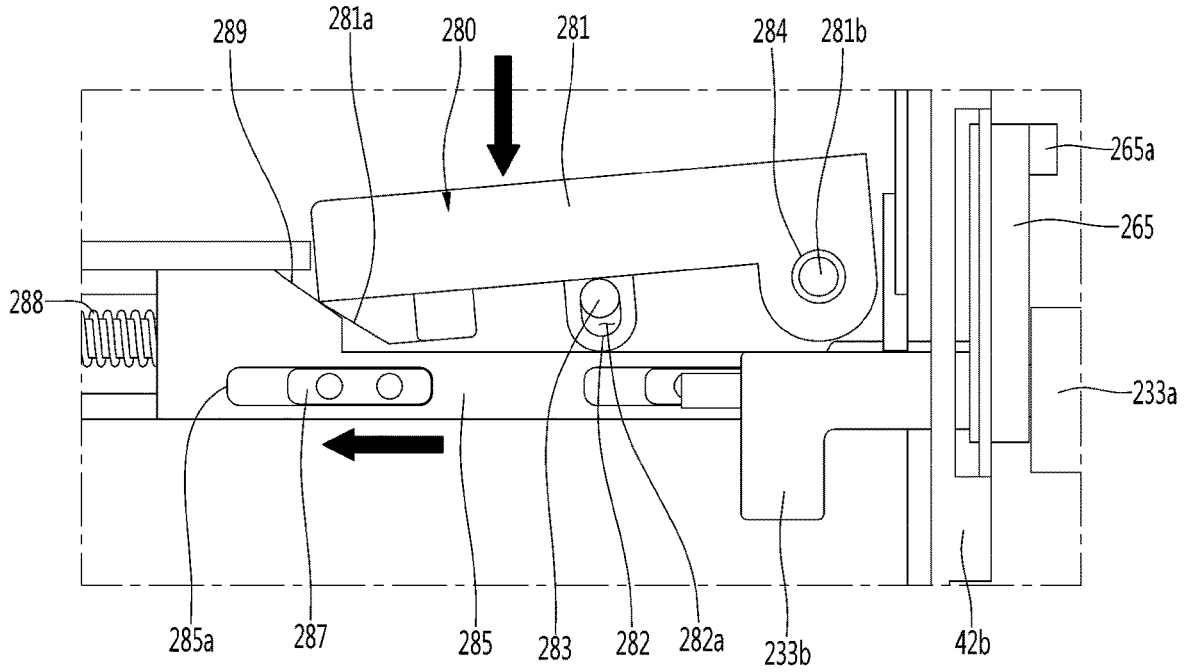
FIG. 14 is a view illustrating constituents of a lever and a lever guide, which act with each other to adjust the vertical height of the shelf according to an embodiment.
Figure 15:
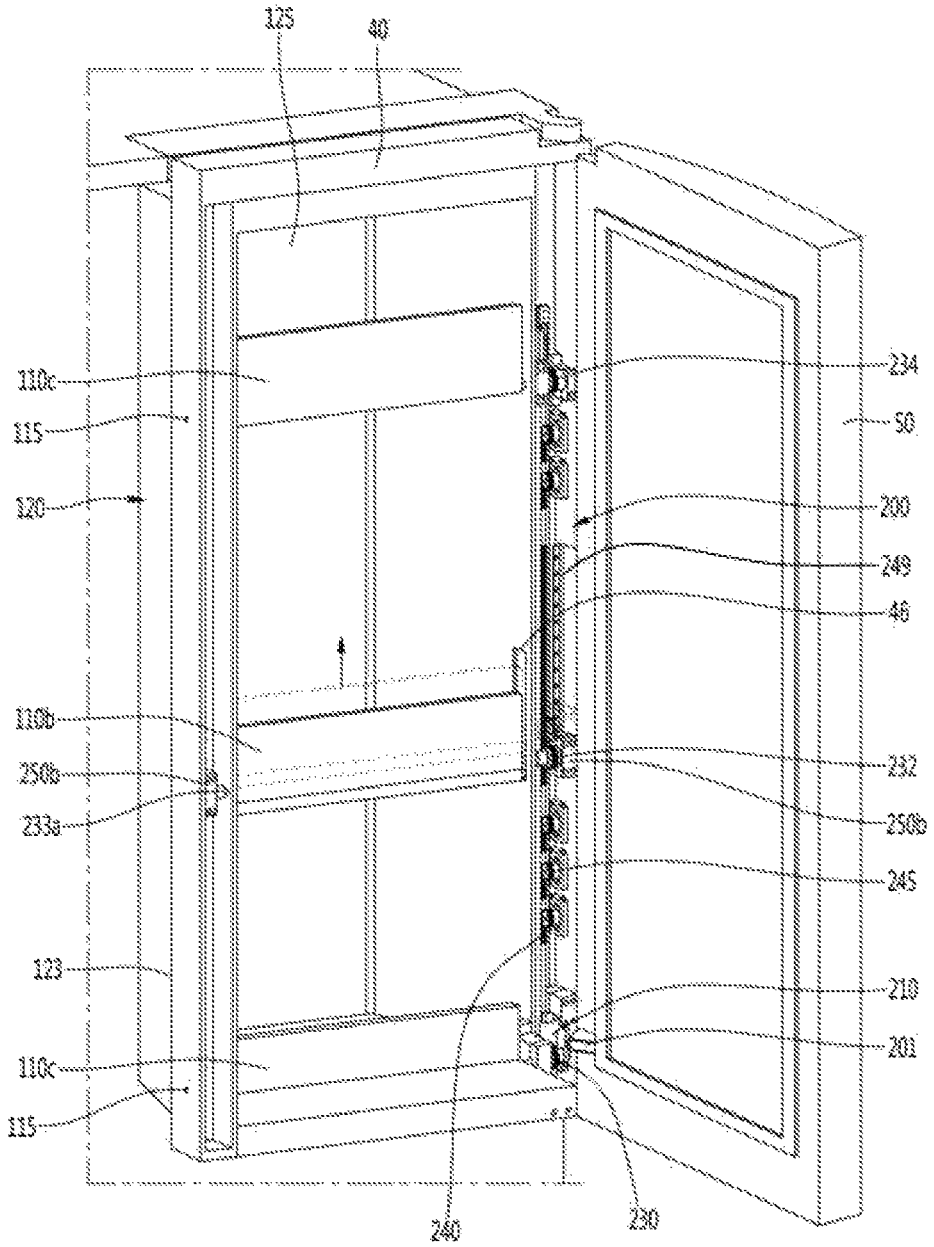
FIG. 15 is a view illustrating a state in which a second shelf moves in a vertical direction according to an embodiment.

FIG. 12 is a view illustrating the device for adjusting the vertical height of the shelf according to an embodiment, FIG. 13 is a view illustrating a state in which the shelf supported on a door is separated, FIG. 14 is a view illustrating constituents of a lever and a lever guide, which act with each other to adjust the vertical height of the shelf according to an embodiment, and FIG. 15 is a view illustrating a state in which the second shelf moves in the vertical direction according to an embodiment.

Referring to FIGS. 12 to 15, the shelf 100 according to an embodiment may be provided to be adjustable in height in the vertical direction. For example, among the plurality of shelves 100, the second shelf 100*b* disposed at an intermediate height may be adjusted in height in the vertical direction.

In detail, the height adjustment device of the second shelf 100*b* includes a support plate 265 supporting the second shelf 100*b* and the second gear assembly 232. The support plate 265 is provided between the second shelf 100*b* and an inner surface of the opening 41.

The height adjustment device includes a lever 280 manipulated by the user. The lever 280 may be installed on the shelf front surface 103*b* of the second shelf 100*b* and may be configured to be exposed to a rear side of the shelf front surface 103*b*.

Due to the manipulation of the lever 280, the support plate 265 may move in a direction closer to the second shelf 100*b*.

In detail, a lever guide 285 for allowing the support plate 265 to move in the left and right direction by being interlocked with the lever 280 is provided inside the second shelf 100*b*. The lever guide 285 may be movably inserted into a guide insertion groove 117 recessed laterally from the lateral surface of the second shelf 100*b*.

The height adjustment device further includes a guide spring 288 that provides restoring force to the lever guide 285. One end of the guide spring 288 is supported on an end of the guide insertion groove 117, and the other end is supported on the lever guide 285. For example, the guide spring 288 includes a compression spring.

A guide protrusion 286 may be provided on an end of the lever guide 285, and the guide protrusion 286 may be inserted into the guide spring 288. Thus, it is possible to prevent the guide spring 288 from being deformed laterally when contracted or tensioned.

The lever guide 285 defines a guide cutoff portion 285*a* that is penetrated in the vertical direction. The guide cutoff portion 285*a* may be defined in the left and right direction corresponding to the moving direction of the lever guide 285.

The guide cutoff portion 285*a* may be provided in plurality and may be arranged in the left and right direction.

The guide pin 287 may be inserted into the guide cutoff portion 285*a*, and the guide pin 287 may be coupled to the second shelf 100*b*. The lever guide 285 may stably move by being supported by the guide pin 287 while the lever guide 285 moves in the left and right direction.

The lever 280 includes a lever body 281 having a first inclined portion 281*a*. The first inclined portion 281*a* may be a surface contacting the lever guide 285 and inclined in the front and rear direction.

The lever guide 285 includes a second inclined portion 289 contacting the first inclined portion 281*a*. The second inclined portion 289 may be provided to be inclined in the front and rear direction so as to correspond to the first inclined portion 281*a*.

When the first inclined portion 281*a* of the lever 280 is moved forward, the lever guide 285 may move in the left direction by the interlock between the first and second inclined portions 281*a* and 289.

A lever stopper 282 is provided at a central portion of the lever body 281 to restrict a rotation distance of the lever 280. The lever stopper 282 protrudes from a front surface of the lever body 281, and an insertion hole that is penetrated vertically is defined in the lever stopper 282.

A lever pin 283 may be inserted into the insertion hole 282*a* of the lever stopper 282, and the lever pin 283 may be coupled to the second shelf 110*b*. The insertion hole 282*a* may have a size that is slightly greater than that of the lever pin 283, and when the lever pin 283 interferes with the insertion hole 282*a* while the lever 280 moves, further movement of the lever 280 may be restricted.

A lever hinge 281*b* defining a rotation center of the lever 280 is provided on the lever 280. The lever hinge 281*b* is provided at a side that is opposite to the first inclined portion 281*a* with respect to the lever stopper 282. That is, the lever stopper 282 may be provided between the first inclined portion 281*a* and the lever hinge 281*b*.

A lever spring 284 is provided on the lever hinge 281*b*. For example, the lever spring 284 may be provided as a torsion spring. Due to the restoring force of the lever spring 284, the lever 28 has force by which the lever 28 rotates in a direction away from the lever guide 285. However, when the lever pin 283 interferes with a front end of the insertion hole of the lever stopper 282, the lever 280 does not rotate any longer.

When the user presses the lever 280 forward, the lever 280 overcomes the restoring force of the lever spring 284, and the first inclined portion 281*a* moves forward with respect to the lever hinge 281*b* to press the second inclined portion 289. Due to the action of the first and second inclined portions 281*a* and 289, the lever guide 285 may move in the left direction.

When the user stops the manipulation of the lever 280, the lever 280 may move to the right side by the restoring force of the guide spring 288 because the first inclined portion

281*a* moves backward to release the force of the first inclined portion 281*a*, which presses against the second inclined portion 289.

The lever guide 285 is coupled to the support plate 265. The support plate 265 may move in the left and right direction together with the lever guide 285.

The support plate 265 may be provided with a protruding support projection 265*a*, and the support projection 265*a* may be inserted into a support groove 274 of the shelf bracket 270.

The shelf bracket 270 may be provided on the first lateral surface 42*b* of the outer part 42 and may have a bar shape extending in the vertical direction. The shelf bracket 270 may be exposed towards the opening 41 through a moving guide hole 46 of the first lateral surface 42*b*.

The moving guide hole 46 may be defined by cutting at least a portion of the first lateral surface 42*b*.

The support groove 274 is provided in plurality, and the plurality of support grooves 274 may be defined to be spaced apart from each other in the vertical direction. In the state in which the second shelf 100*b* is moved in the vertical direction and is adjusted in height, when the support projection 265*a* is inserted into any one of the plurality of support grooves 274, the second shelf 100*b* may be maintained in a state of being supported on the shelf bracket 270. In this manner, the second shelf 100*b* may be adjusted at a predetermined height in multiple stages.

The second connection bar 233*b* is inserted into the support plate 265. The second connection bar 233*b* may pass through the support plate 265 and be coupled to the second shelf guard 110*b*. Also, the second connection bar 233*b* may rotate within the support plate 265.

A support protrusion protruding in a circumferential direction is provided on an outer circumferential surface of the second connection bar 233*b*. The support protrusion may be provided in plurality to interfere with left and right surfaces of the support plate 265.

The first support protrusion 267 may be provided between the left surface of the support plate 265 and the lateral surface of the second shelf 100*b* to interfere with the left surface of the support plate 265. Also, the second support protrusion 268 may be provided between the right surface of the support plate 265 and the connection cylinder 233A to interfere with the right surface of the support plate 265.

When the support plate 265 moves in the direction that is directed to the second shelf 100*b*, the support plate 265 may press against the first support protrusion 267, and the connection bar 233*b* may be inserted into the second shelf guard 110*b*. That is, a depth to which the connection bar 233*b* is inserted into the second shelf 100*b* may increase (see FIG. 13).

On the other hand, when the support plate 265 moves in a direction away from the second shelf 100*b*, the support plate 265 may press against the second support protrusion 268, and the connection bar 233*b* may protrude to the outside of the second shelf guard 110*b*. That is, a depth to which the connection bar 233*b* is inserted into the second shelf 100*b* may decrease (see FIG. 12).

A bar insertion groove 118 which is recessed from the lateral surface of the second shelf guard 110*b* and into which the connection bar 233*b* is inserted may be defined in the second shelf guard 110*b*. The connection bar 233*b* may move in the left and right direction from the inside of the bar insertion groove 118.

The height adjustment device further includes a support bar 266 that protrudes from the support plate 265 and is coupled to the lateral surface of the second shelf 100*b*. The support bar 266 may connect the support plate 265 to the second shelf 100*b* to improve the supporting force for the second shelf 100*b*.

An insertion groove into which the support bar 266 is inserted is defined in the lateral surface of the second shelf 100*b*. In the state in which the support bar 266 is inserted into the insertion groove of the second shelf 100*b*, an insertion depth of the support bar 266 may be adjusted. That is, when the support plate 265 moves in the direction towards the second shelf 100*b*, the support bar 266 may move to increase in insertion depth inside the second shelf 100*b*.

The operation in which the second shelf 100*b* is adjusted in vertical height by the manipulation of the lever 280 will be briefly described.

In a state in which the user does not manipulate the lever 280, the lever guide 285 and the support plate 265 may be disposed relatively to the right side. Here, the support projection 265*a* may be in a state of being inserted into the support groove 274. Also, the pinion gear 232*a* of the second gear assembly 232 is in a state of being coupled to the gear teeth 240*a* of the second rack gear 240.

When the user presses the lever 280, the lever guide 285 may move to the left side by the interaction between the lever 280 and the lever guide 285, and the support plate 265 may also move in the direction closer to the second shelf 100*b*.

Also, since the second gear assembly 232 is in the state of being supported on the support plate 265 by the support protrusion 267, the second gear assembly 232 may also move towards the second shelf 100*b*.

Here, the gear shaft 232*b* of the second gear assembly 232 may be withdrawn from the second gear bracket 250*b* in the direction that is directed to the second shelf 100*b*. However, the second gear assembly 232 is not completely separated from the second gear bracket 250*b* and maintained in a state of being supported by the second gear bracket 250*b* through the gear shaft 232*b*.

According to the movement of the support plate 265, the support projection 265*a* may be separated from the support groove 274, and the pinion gear 232*a* may be separated from the second rack gear 240. Thus, the force restricting the vertical movement of the second shelf 100*b* may be removed.

In this state, the user may allow the second shelf 100*b* to ascend or descend. When the second shelf 100*b* moves in the vertical direction, the support plate 265 and the second gear assembly 232 move together. Also, the second gear bracket 250*b* may move in the vertical direction along a bracket rail 249 (see FIG. 15).

When the second shelf 100*b* reaches a desired height, the user may stop the manipulation of the lever 280. When the pressing of the lever 280 is stopped, each of the lever 280 and the lever guide 285 may return to its original position.

The support plate 265 and the second gear assembly 232 may move in a direction away from the second shelf 100*b*. Also, the support projection 265*a* of the support plate 265 may be inserted into any one of the support grooves 274 of the plurality of support grooves 274, and the pinion gear 232*a* of the second gear assembly 232 may be interlocked with the gear teeth 240*a* of the second rack gear 240.

Also, the gear shaft 232*b* of the second gear assembly 232 may be introduced into the second gear bracket 250*b*.

Due to this operation, the user may allow the second shelf 100*b* to easily move in the vertical direction, thereby adjusting the height of the second shelf 100*b*.

According to the above-described solution, the shelf guard may rotate so that the top surfaces of the shelf and the shelf guard are provided as a flat surface, and food may be easily taken out along the flat surface.

When the refrigerator door is opened, the upper portion of the shelf guard may rotate with respect to the lower portion of the shelf guard in the top and down manner to allow the shelf guard to extend to the front side of the door.

The plurality of shelves may be arranged in the vertical direction, and the plurality of shelf guards may be provided. The plurality of shelf guards may rotate together so that the user does not need to manipulate the shelf guards one by one so as to extend the shelf guards.

The shelf guard may act with the refrigerator door so that the shelf guard rotates only by opening or closing the refrigerator door to increase in user's convenience.

The volume of the door accommodation space may be changed by adjusting the height of the shelf. Particularly, the height of the shelf may be easily adjusted by the user's lever operation.

The shelf guard may be rotatable, and also, the shelf may be adjusted in height to improve the user's convenience.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art and encompassed by the appended claims.

What is claimed is:

1. A refrigerator comprising:

a cabinet defining a storage space;

a door provided in front of the cabinet, the door comprising a main door including an opening and a sub door to open or close the opening of the main door;

first and second shelf guards;

a plurality of shelves associated with the first and second guards provided inside the cabinet, the first and second shelf guards disposed at the opening of the main door to protrude upward from a front end of the plurality of shelves so as to provide a protrusion, the first and second shelf guards being arranged to be spaced from each other in a vertical direction and being provided to be movable; and a rotation guide device to guide a movement of the first or second shelf guards so that, when the sub door is opened, the rotation guide device operates with the opening of the sub door to allow the first and second shelf guards to move and extend to a front side of the opening, wherein the rotation guide device comprises:

a projection provided at the sub door;

a moving part provided at the main door, the moving part being movable by the projection when the sub door closes the opening of the main door and including a first rack gear;

a first gear assembly configured to allow the first shelf guard to rotate and including a first pinion gear interlocked with the first rack gear and a second pinion gear;

a second rack gear interlocked with the second pinion gear and extended in the vertical direction on a side of the opening; and a second gear assembly provided at a height corresponding to the second shelf guard to allow the second shelf guard to rotate and interlocked with the second rack gear.

2. The refrigerator according to claim 1, wherein the rotation guide device further comprises:

a support bracket to movably support the moving part; and a bracket guide provided in a space between a front portion and a rear portion of the support bracket, the bracket guide being inserted into the moving part, wherein the moving part moves in the space between the front portion and the rear portion of the support bracket.

3. The refrigerator according to claim 2, wherein the rotation guide device further comprises a bracket spring provided at the support bracket to provide restoring force to the moving part so that the moving part advances forward when the sub door is being opened.

4. The refrigerator according to claim 2, wherein the first gear assembly is interlocked with the moving part and coupled to the first shelf guard, and the first gear assembly comprises a connection bar coupled to a lateral surface of the first shelf guard so that an upper portion of the first shelf guard rotates forward with respect to a lower portion of the first shelf guard.

5. The refrigerator according to claim 4, wherein the second rack gear is interlocked with the first and second gear assemblies so that the first and second shelf guards rotate together, and the second rack gear extends vertically from a lower shelf to an upper shelf among the plurality of shelves.

6. The refrigerator according to claim 5, wherein each of the first and second gear assemblies is provided on a side of each of the plurality of shelf guards.

7. The refrigerator according to claim 5, wherein the rotation guide device further comprises a reduction gear interlocked with the second rack gear to reduce a vertical moving speed of the second rack gear.

8. The refrigerator according to claim 4, further comprising:

a shelf bracket to support the plurality of shelves, the shelf bracket having a plurality of support grooves defined in a vertical direction; and a support plate having a support projection capable of being inserted into one of the plurality of support grooves.

9. The refrigerator according to claim 8, further comprising:

a lever provided on the plurality of shelves, the lever being manipulatable to adjust a vertical height of the plurality of shelves; and a lever guide disposed in contact with the lever, the lever guide to move in a left and right direction by movement of the lever, wherein the lever guide is coupled to the support plate.

10. The refrigerator according to claim 9, further comprising a first inclined portion provided on the lever and a second inclined portion provided on the lever guide to contact the first inclined portion, wherein each of the first and second inclined portions has a surface extending to be inclined in a front and rear direction.

11. The refrigerator according to claim 9, wherein the support plate is provided between a lateral surface of the plurality of shelves and an inner surface of the main door, and when the lever guide moves by the manipulation of the lever, the support plate moves in a direction that approaches the lateral surface of the plurality of shelves so that the support projection inserted in the support groove is separated from the support groove.

12. The refrigerator according to claim 11, wherein, when the support plate moves in the direction that approaches the lateral surface of the plurality of shelves by the manipulation of the lever, the first or second gear assembly is separated from the second rack gear.

13. The refrigerator according to claim 8, wherein the support plate is coupled to at least one of the first and second gear assemblies.

14. The refrigerator according to claim 1, wherein the plurality of shelves comprises a first shelf and a second shelf spaced upward from the first shelf, and a third shelf is spaced upward from the second shelf, and the first and third shelves are fixed and the second shelf is movable in the vertical direction.

15. A refrigerator comprising:

a cabinet defining a storage space;

a door provided in front of the cabinet, the door to open or close the storage space;

a shelf provided inside the cabinet;

a shelf guard protruding upward from a front end of the shelf when the door is closed, the shelf guard being provided to be movable;

a rotation guide device to guide movement of the shelf guard so that the rotation guide device operates with the door to allow the shelf guard to rotate;

a shelf bracket to support the shelf, the shelf bracket having a plurality of support grooves defined in a vertical direction;

a support plate having a support projection capable of being inserted into one of the plurality of support grooves; and a lever provided on the shelf, the lever being manipulatable to adjust a vertical height of the shelf, the lever comprising:

a lever body having a first contact portion;

a lever hinge defining a rotation center of the lever, the lever hinge being opposite to the first contact portion;

a lever guide coupled to the support plate and movable by rotation of the lever, the lever guide including a second contact portion interlocked with the first contact portion, wherein the second contact portion moves linearly when the first contact portion presses the second contact portion while the lever rotates, to allow the support projection to be separated from the one of the plurality of support grooves.

16. The refrigerator according to claim 15, wherein the rotation guide device comprises:

a projection provided on the door; and a moving part movable by the projection when the door closes the storage space, a support bracket to movably support the moving part; and a bracket guide provided in a space between a front portion and a rear portion of the support bracket, the bracket guide being inserted into the moving part.

17. The refrigerator according to claim 16, wherein the rotation guide device further comprises a bracket spring provided on the support bracket to provide restoring force to the moving part so that the moving part advances forward when the door is opened.

18. The refrigerator according to claim 16, wherein the rotation guide device further comprises a gear assembly interlocked with the moving part and coupled to the shelf guard, and the gear assembly comprises a connection bar coupled to a lateral surface of the shelf guard so that an upper portion of the shelf guard rotates forward about a lower portion of the shelf guard.

19. The refrigerator according to claim 15, wherein the door comprises a main door including an opening and a sub door to open or close the opening of the main door, and the rotation guide device operates with the sub door.

20. The refrigerator according to claim 15, wherein the first contact portion includes a first inclined portion provided on the lever and the second contact portion includes a second inclined portion provided on the lever guide to contact the first inclined portion, wherein each of the first and second inclined portions has a surface extending to be inclined in a front and rear direction.

21. The refrigerator according to claim 15, wherein the first contact portion includes a first inclined surface, and the second contact portion includes a second inclined surface contacted with the first inclined surface.

22. The refrigerator according to claim 15, wherein the support plate is located at a lateral side of the shelf, and wherein the lever guide is movably inserted into a guide insertion groove recessed laterally from the lateral surface of the shelf.

23. The refrigerator according to claim 22, further comprising a guide spring that provides restoring force to the lever guide, wherein a first end of the guide spring is supported on the guide insertion groove, and a second end of the guide spring is supported on the lever guide.

24. The refrigerator according to claim 15, further comprising:

a guide cutoff formed in the lever guide; and a guide pin inserted into the guide cutoff portion, the guide pin being coupled to the shelf such that the lever guide moves by being supported by the guide pin while the lever guide linearly moves.

25. The refrigerator according to claim 15, wherein the lever further comprises a lever stopper configured to restrict a rotation distance of the lever, the lever stopper being provided between the first contact portion and the lever hinge.

26. The refrigerator according to claim 25, further comprising a lever pin inserted into an insertion hole of the lever stopper and coupled to the shelf, wherein the lever pin is configured to interfere with the insertion hole while the lever rotates, further rotation of the lever is restricted.

27. The refrigerator according to claim 15, further comprising a lever spring provided in the lever hinge and configured to provide a restoring force to the lever.

28. A refrigerator comprising:

a cabinet defining a storage space;

a door provided in front of the cabinet, the door comprising a main door including an opening and a sub door to open or close the opening of the main door;

a shelf provided inside the cabinet;

a shelf guard disposed at the opening of the main door to protrude upward from a front end of the shelf so as to provide a protrusion, the shelf guard provided to be movable;

a rotation guide device to guide a movement of the shelf guard so that, when the sub door is opened, the rotation guide device operates with the opening of the sub door to allow the shelf guard to move and extend to a front side of the opening;

wherein the rotation guide device further comprises:

a projection provided at the sub door; and a moving part provided at the main door, the moving part being movable by the projection when the sub door closes on the opening of the main door;

a gear assembly interlocked with the moving part and coupled to the shelf guard;

wherein each of the shelf and the shelf guard are provided in plurality, the gear assembly is provided in plurality, each gear assembly has a corresponding shelf guard, the rotation guide device comprises a rack gear interlocked with the plurality of gear assemblies so that the plurality of shelf guards rotate together, and the rack gear extends vertically from a lower shelf to an upper shelf among the plurality of shelves.

* * * * *